US008777486B2

(12) United States Patent
Miyake et al.

(10) Patent No.: US 8,777,486 B2
(45) Date of Patent: Jul. 15, 2014

(54) PACKAGING BAG WITH STEAM VENTING FUNCTION AND PACKAGE USING THE PACKAGING BAG

(75) Inventors: Hidenobu Miyake, Taito-ku (JP); Kouichi Shiozaki, Taito-ku (JP); Yukihiro Nakamura, Taito-ku (JP); Ikuno Shimeno, Taito-ku (JP); Atsushi Tsujii, Taito-ku (JP); Kayoko Hamada, Taito-ku (JP); Hirofumi Kawai, Taito-ku (JP); Kiyoshi Sawada, Taito-ku (JP); Noriyuki Araki, Taito-ku (JP); Masashi Goto, Taito-ku (JP)

(73) Assignee: Toppan Printing Co., Ltd., Tokyo (JP)

( * ) Notice: Subject to any disclaimer, the term of this patent is extended or adjusted under 35 U.S.C. 154(b) by 2238 days.

(21) Appl. No.: 10/565,272

(22) PCT Filed: Jul. 23, 2004

(86) PCT No.: PCT/JP2004/010891

§ 371 (c)(1),
(2), (4) Date: Jul. 10, 2006

(87) PCT Pub. No.: WO2005/009869

PCT Pub. Date: Feb. 3, 2005

(65) Prior Publication Data

US 2006/0257056 A1 Nov. 16, 2006

(30) Foreign Application Priority Data

| | | |
|---|---|---|
| Jul. 24, 2003 | (JP) | 2003-278921 |
| Oct. 23, 2003 | (JP) | 2003-362895 |
| Oct. 23, 2003 | (JP) | 2003-362896 |
| Oct. 31, 2003 | (JP) | 2003-371934 |
| Nov. 7, 2003 | (JP) | 2003-377972 |
| Jan. 29, 2004 | (JP) | 2004-021359 |
| Jan. 29, 2004 | (JP) | 2004-021360 |
| Apr. 27, 2004 | (JP) | 2004-131017 |
| Apr. 27, 2004 | (JP) | 2004-131018 |

(51) Int. Cl.
*B65D 33/01* (2006.01)

(52) U.S. Cl.
USPC ..... 383/103; 383/100; 383/45

(58) Field of Classification Search
USPC ..... 383/100, 103, 43–45, 59, 101, 102
See application file for complete search history.

(56) References Cited

U.S. PATENT DOCUMENTS

| | | | | |
|---|---|---|---|---|
| 2,171,718 | A * | 9/1939 | Vogt | 383/78 |
| 3,378,189 | A * | 4/1968 | Dickson | 383/94 |
| 4,491,959 | A * | 1/1985 | Loefberg | 383/103 |
| 4,848,928 | A * | 7/1989 | Ausnit | 383/5 |
| 5,480,230 | A * | 1/1996 | May | 383/9 |
| 6,361,209 | B1 * | 3/2002 | LaRue et al. | 383/10 |
| 6,641,307 | B2 * | 11/2003 | Matsuda et al. | 383/38 |
| 6,655,837 | B2 * | 12/2003 | Matsuda et al. | 383/38 |
| 7,004,632 | B2 * | 2/2006 | Hamilton et al. | 383/103 |
| 7,036,986 | B2 * | 5/2006 | Matsuda et al. | 383/38 |
| 7,452,132 | B2 * | 11/2008 | Tang | 383/63 |
| 7,635,222 | B2 * | 12/2009 | Plourde et al. | 383/63 |
| 2003/0123758 | A1 * | 7/2003 | Mita et al. | 383/38 |
| 2004/0045842 | A1 * | 3/2004 | Matsuda et al. | 206/219 |
| 2005/0031229 | A1 * | 2/2005 | Tang | 383/103 |

FOREIGN PATENT DOCUMENTS

| | | | | |
|---|---|---|---|---|
| JP | 10-101154 | | 4/1998 | |
| JP | 2001-10678 | | 1/2001 | |
| JP | 2001-010678 | | 1/2001 | |
| JP | 2001-270569 | | 10/2001 | |
| JP | 2002-249177 | | 9/2002 | |
| JP | 2003-182780 | | 7/2003 | |
| JP | 2005059867 | A * | 3/2005 | B65D 81/34 |
| WO | WO 2005012134 | A1 * | 2/2005 | B65D 81/34 |

OTHER PUBLICATIONS

International Preliminary Report on Patentability, dated Apr. 27, 2006.

Patent Abstracts of Japan, Publication No. 2001-010678, published Jan. 16, 2001.

Patent Abstracts of Japan, Publication No. 2002-249177, published Sep. 3, 2002.

Patent Abstracts of Japan, Publication No. 2003-182780, published Jul. 3, 2003.

* cited by examiner

*Primary Examiner* — Jes F Pascua
*Assistant Examiner* — Peter Helvey
(74) *Attorney, Agent, or Firm* — Staas & Halsey LLP

(57) ABSTRACT

A packaging bag having a steam venting function capable of releasing pressure inside a package even when heating cooking is performed by a microwave oven and preventing the inside of the bag from being contaminated and the package using the packaging bag. The packaging bag includes two pieces of front and back main body films having sealant layers which are opposed to each other with the sealant layers facing inward, side seal parts, and a bottom seal part. The front body film is folded in the vicinity of the bottom seal part throughout the entire width of the bag and parallel with the bottom seal part to form a fold-in part. A steam venting port is formed in the fold-in part, and an easily peelable tape covering the steam venting port is disposed on the inside of the fold-in part throughout the width of the bag and parallel with the fold-in part, and then heat-sealed.

9 Claims, 15 Drawing Sheets

PACKAGING BAG WITH STEAM VENTING FUNCTION AND PACKAGE USING THE PACKAGING BAG

This application claims the benefit of PCT International Application Number PCT/JP 2004/0101891, filled in Jul. 23, 2004 and Japanese Application Nos. 2003-278921, filled Jul. 24, 2003, 2003-362895, filled Oct. 23, 2003, 2003-362896, filled Oct. 23, 2003, 2003-371934, filled Oct. 31, 2003, 2003-377972, filed Nov. 7, 2003, 2004-021359, filled Jan. 29, 2004, 2004-021360, filled Jan. 29, 2004, 2004-131017, filled Apr. 27, 2004, 2004-131018, filled Apr. 27, 2004 in Japan, the disclosures of which are incorporated herein by reference.

TECHNICAL FIELD

The present invention relates to a packaging bag which keeps foods and the like, especially relates to the packaging bag having a steam venting function wherein a steam venting port is opened by a force of an emitted steam when heated by means of a heating means such as a microwave oven and the like, and relates to a package using the packaging bag.

BACKGROUND ART

In recent years, bag-packed foods wherein bags are filled with ready-made or semi-cooked foods and the like and those are poured into the packaging bags made of heat resistant films and thus bag-packed foods are heated and cooked by a microwave oven just before eating, have widely come into the market.

Such packed foods for cooking use when heated directly by the microwave oven without opening, may possibly contaminate the inner side of the microwave oven by rupturing the packaging bag and scattering contents as a result of raising the internal pressure by generated steam and the like which is emitted from foods.

Accordingly, the rupture of the packaging bag has been prevented, for example, by opening a small air hole and the like or by cutting off a portion by use of scissors and the like to the packaging bag before cooking by the microwave oven, in order to avoid the increase of the internal pressure within the inner side of the packaging bag.

However, by such method, since the steam emitted after heating is released immediately to the outside of the packaging bag, the steam-cooking effect by the steam decreases and the deterioration of foods may occur as a result of an acceleration of food dehydration in the packaging bag.

Accordingly, a packaging bag is provided by a sealed package; wherein, for example, as shown in FIG. 17(*a*), a laminated film 101 is made as a cylindrical shape, and at the same surface side, the facing two-edge parts of the film are laid on each other in a butt-seam manner, and as shown in FIG. 17(*b*), the laid-on sides are joined by heat-sealing to form an easily peelable region in a part of the region throughout an entire length in a longitudinal direction, and a cylindrical body is formed by providing a predetermined width of a heat-sealing part 102, and after said heat-sealing part 102 is made to be one-sided to one edge side of the cylinder, and after the bag is fabricated by providing a bottom heat-sealing part 103 by heat-sealing a lower line part of the cylindrical body excluding the lower line part of the heat-sealing part 102, contents 105 are filled in from an upper line part of an opening part of the cylindrical body, and then as shown in FIG. 17(*c*), the upper line part of the cylindrical body is heat-sealed to provide a heat-sealing part 104 of the upper part excluding the upper line part of the heat-sealing part 102.

The packaging bag is described as capable to conduct the steam pressure relief, when the steam pressure of the internal bag is raised while heating, an easily peelable region which is made in a part of region in the heat-sealing part 102 delaminates to release the steam (JP09-150864, A (1997)).

Also, for a part of films of constituting the packaging bag, a device to use an air permeable film is proposed (JP10-129748, A (1998)).

Moreover, a device is proposed where a narrow seal width is provided to comprise a narrow seal width in a part of the region in a back seal part of the packaging bag and in the region of the narrow width part a cutting is made to form an opening which is capable to open by the internal pressure of the bag (JP11-278557, A (1999)).

The packaging bag, which is made so as to conduct the steam releasing from a part of the heat-sealed packaging bag film as an easily peelable state, is advantageous from the point of fabricating for the reason that different materials are not used, but even if such packaging bag is applied, when an appearance after heating is observed, a scattering of contents is found in the easily peelalble region provided in a part of the region of the heat-seal part of the packaging bag so that the scattering of the contents in the perfect state and a stain of the inside of the microwave oven are not considered to be avoidable.

SUMMARY OF THE INVENTION

The subject of the present invention is to solve the above mentioned problem and to provide a packaging bag and a package using the packaging bag having a steam venting function capable of releasing the internal pressure of the package even when heating cooking is conducted by a microwave oven and preventing the circumference of the bag or an inside of the microwave from being stained.

In order to achieve the above mentioned object, the present invention is to provide with a packaging bag having the steam venting function; wherein the packaging bag includes two sheets of front and back main body films having respective sealant layers that are laid on by making facing said sealant layers inward, and a bottom seal part and side seal parts are provided by sealing three sides, and a space of a top intended part for heat seal is opened; and a fold-in part, including facing an inner sheet part and an outer sheet part by bending the main body film of the front side into Z shape, is formed in the main body film of the front side in the vicinity of the bottom seal part across an entire bag width making parallel to said bottom seal part; and the above mentioned fold-in part has a steam venting port; and a seal part is provided wherein an easily peelable tape having an easily pealable property is provided on one side throughout a width direction of the bag making parallel to the fold-in part in an inside of the fold-in part and an easily peelable side of the easily peelable tape is heat-sealed in making positioning to the inner sheet part side of the fold-in part; and the easily peelable seal part made as a capable of a delamination by thermal welding of the easily peelable side of the easily peelable tape in the above mentioned seal part and a sealant layer of the above mentioned inner sheet part, is positioned around said steam venting port so as to solve the above mentioned subject.

Also, referring to the present invention, it is possible that an opposite side of the above mentioned easily peelable side of the easily peelable tape is made as a high strength adhesive side, and said seal part is provided by heat-sealing in making said easily peelable side of the easily peelable tape positioning to the inner sheet part side of the fold-in part and in making the high strength adhesive side of the easily peelable tape positioning to the outer sheet part side of the fold-in part, and said high strength adhesive side of the easily peelable tape in said seal part and the sealant layer of the outer sheet part are thermally welded so that the delamination by the steam pressure is made to be incapable.

Also, referring to the present invention, it is possible that the above mentioned steam venting port is provided by cutting the above mentioned seal part.

Also, referring to the present invention, it is possible that the above mentioned seal part has one non-seal part or more including a non-seal region with one side continuous to a mountain folding edge of the fold-in part while three sides are surrounded by a seal region and the above mentioned steam venting port is positioned in said non-seal parts.

Also, referring to the present invention, it is possible that in the above mentioned fold-in part the multiple numbers of the above mentioned seal parts are provided in making a discontinuous state through the non-seal parts including the non-heat-seal region Also, referring to the present invention, it is possible that the steam venting port of the above mentioned seal part is adjacent to the above mentioned non-seal part situated between the seal parts.

Also, referring to the present invention, it is possible that the seal part located at the center of the above mentioned fold-in part has the non-seal part of the non-heat-seal region with one side continuous to the mountain folding edge of the fold-in part while three sides are surrounded by the seal region, and in the non-seal part, the above mentioned steam venting port is located by making a convex against the opposite side of the mountain folding edge, and in the above mentioned both sides of the central seal part, a lateral side seal part is provided by having the non-seal part of the non-heat-seal region with one side continuous to the mountain folding edge of the fold-in part while three sides are surrounded by the seal region, and the above mentioned seal part in the center of the fold-in part and the lateral seal part are provided to side by side through the non-seal part.

Also, referring to the present invention, it is possible that in the seal part of the above mentioned center of the fold-in part, a seal width of the width direction of the bag of a vertical part continuous to the mountain folding edge of the seal region is wider than a seal width in the direction perpendicular to the width direction of the bag of a horizontal part along the width direction of the bag of the seal region.

Also, referring to the present invention, it is possible that in respective above mentioned lateral side seal parts, the vertical part of the side seal part side of the seal region is extended to the opposite side of the mountain folding edge of the fold-in part and the horizontal part of the seal region is inclined as approaching from the above mentioned central seal part side to the side seal part side so as to be one-sided to the opposite side with the mountain folding edge.

Also, referring to the present invention, it is possible that the above mentioned lateral side seal part is provided to a line symmetry making the packaging bag vertical central line as an axis of symmetry.

Also, referring to the present invention, it is possible that in both edges of the above mentioned fold-in part, the non seal part including the non-heat-seal region between said seal part and the side seal part is provided and said non-seal part is the line symmetry making the vertical central line of the packaging bag as the axis of symmetry.

Also, referring to the present invention, it is possible that the high strength adhesive side of a lower edge part in the above mentioned easily peelable tape is thermally welded to a sealant layer of the above mentioned outer sheet part throughout a longitudinal direction of the tape in an incapable state of the delamination by the steam pressure.

Also, referring to the present invention, it is possible that an edge part of said easily peelable tape is positioned between the main body films of the fold-in part in the side seal part of said fold-in part, and a punched hole is provided in said edge part of said easily peelable tape and the sealant layers of the main body films are thermally welded each other through said punched hole in a direct manner.

Also, referring to the present invention, it is possible that the lateral side seal part made by heat-sealing of the inner sheet part and the outer sheet part of the fold-in part with making to position the above mentioned easily peelable tape in between, and situated nearer to the above mentioned side seal part, is provided across in a direction perpendicular to the width direction of the bag of the fold-in part, and said lateral side seal part is continued to the seal part having heat-sealing of the facing front and back main body films each other in contents filled region.

Also, referring to the present invention, it is possible that the seal width of the side seal part in the vicinity of the above mentioned bottom seal part is made to be narrower than the seal width of the side seal part in the vicinity of the top intended part for heat seal situated facing to the bottom seal, and the seal width of the side seal part becomes wider as approaching from the vicinity position of the bottom seal part to the vicinity of the above mentioned top intended part for heat seal.

Also, referring to the present invention, it is possible that the above mentioned steam venting port is any one of a small hole, cutting out, or slit.

Also, referring to the present invention, it is possible that in the vicinity of the top intended part for heat seal located facing to the bottom seal part, an easily cutting means can be provided.

Also, referring to the present invention, it is possible that the package having the steam venting function is provided and the above mentioned subject is solved by providing the package; wherein from the top intended part for heat seal side of the packaging bag having the steam venting function, contents are filled and said top intended part for heat seal is sealed by heat-sealing, and the main body film which the fold-in part is formed, is laid horizontally by making to face up and heated, and, by the swollen deformation of the packaging bag by the increased inner pressure, the delamination is made between the inner sheet part and the easily peelable tape in the peelable seal region in the seal part of the fold-in part so that the steam is made to vent from the opened steam venting port.

According to the present invention, the top intended part for heat seal after filling contents is made as a sealed form, and this is heated by a heating means as a microwave oven, and then swells when the internal pressure is increased by the generation of the steam and, the steam venting port is opened by making the delamination of the easily peelable tape from the inner sheet part of the fold-in part and the steam is made so as to release from the steam venting port so that the packaging bag does not perform in such a manner to burst.

Also, according to the present invention, as the form which the top intended part for heat seal is heat-sealed after contents are filled, and this is heated by heating means such as the microwave oven, and when the inner sheet part and the outer sheet part of the fold-in part are separated as a result of swelling of the packaging bag, the easily peelable tape remains to the outer sheet part in the adhered state, and the above mentioned easily peelable tape positively separates from the inner sheet part, and the steam venting port opens and simultaneously, the space connected to the steam venting port from contents filled space is appropriately made so as to be formed.

Also, according to the present invention, since the steam venting port is provided by making a cutting to the seal closing port, the steam venting port which is made so as to be closed when the internal pressure is not added to the packaging bag in the form which the top intended part for heat seal is heat-sealed after contents are filled, can be easily formed.

Also, according to the present invention, when the internal pressure of the bag is increased and the easily peelable seal part is delaminated, the steam venting port is made to open more appropriately. And, the shape of the steam venting port becomes more flexible so that various shapes of the steam venting port can be made.

Also, according to the present invention, when the easily peelable seal part delaminates as a result of the increase of the internal pressure in the bag, opened multiple steam venting ports are obtained and the steam venting is positively made to be performed.

Also, according to the present invention, when the easily peelable seal part delaminates as a result of the increase of the internal pressure in the bag, the steam venting port is made to be opened more positively.

Also, according to the present invention, when the easily peelable seal part delaminates as a result of the increase of the internal pressure in the bag, a flow of the steam from contents filled space in the bag to the steam venting port of the central seal part of the fold-in part is fixed so that the steam flow becomes stable and the steam venting without turbulence can be made to perform.

Also, according to the present invention, in the seal part having the steam venting port, when the easily peelable seal part delaminates as a result of the increase of the internal pressure in the bag, a seal retraction (the delamination acceleration of the easily peelable seal part) toward the mountain folding edge of the fold-in part is kept down so that the flow of the steam passing through the steam venting gate can be made so as to control, and the scattering of solid contents as a result of bumping can be prevented, and simultaneously the appropriate pressure effect such as steaming and the like against the contents can be made to provide by controlling the internal pressure of the bag.

Also, according to the present invention, the delamination at the side part of the fold-in part can be made so as to be avoided when the internal pressure of the bag increases so that the steam from the steam venting port can be made to make a discharge positively from the steam venting port.

Also, according to the present invention, since the delamination at the side part of the fold-in part can be made so as to be avoided when the internal pressure of the bag increases so that the steam from the steam venting port can be made to make the discharge positively from the steam venting port.

Also, according to the present invention, the delamination at the side part of the fold-in part can be made so as to be avoided when the internal pressure of the bag increases so that the steam from the steam venting port can be made to make the discharge positively from the steam venting port.

Also, according to the present invention, the contents flown by bumping can be made to be prevented from entering into the space between the easily peelable tape and the outer sheet part of the fold-in part.

Also, according to the present invention, the delamination at the side part of the fold-in part can be made so as to be avoided when the internal pressure of the bag is increased so that the steam from the steam venting port can be made to make the discharge positively from the steam venting port.

Also, according to the present invention, the delamination at the side part of the fold-in part can be made so as to be prevented at the increase of the internal pressure of the bag, the steam from the steam venting port can be made to make the discharge positively from the steam venting port.

Also, according to the present invention, the center of the bag in the swollen state of the bag is one-sided to the steam venting port side so that the pressure to the top seal part side is relaxed and even the top seal part is in the impurities seal state, the seal region of the top seal part retracts to make so as to prevent from the delamination.

Also, according to the present invention, the formation of the steam venting port is easily performed.

Also, according to the present invention, an opening after cooking can be performed manually without the use of tools as scissors and the like.

Also, according to the present invention, the package, which can release the steam appropriately without staining the inner oven while cooking by the microwave oven, is made for the microwave oven cooking use.

DESCRIPTION OF THE EMBODIMENTS

A packaging bag having a steam venting function and a package using the packaging bag will now be explained in detail according to the embodiments of the present invention.

(The First Embodiment of the Present Invention)

Figure 1:
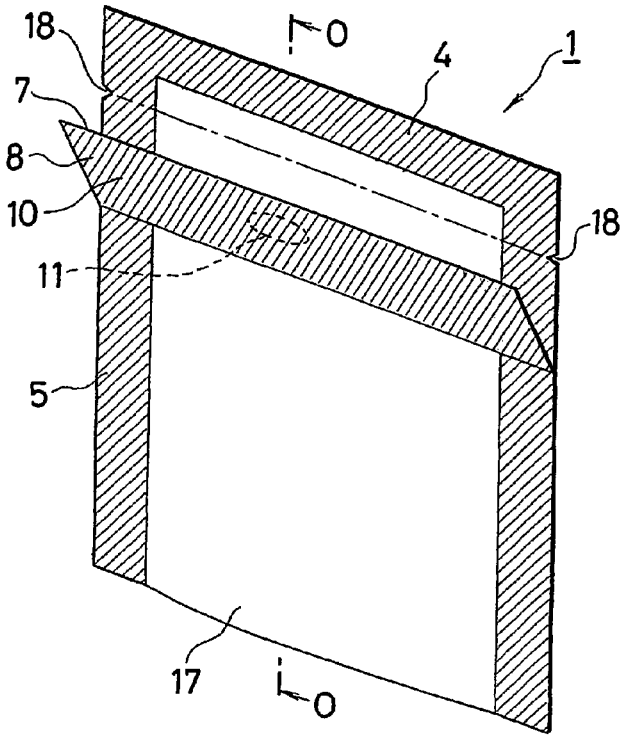
FIG. 1(*a*) illustrates a state of a perspective view, (b) illustrates a cross-sectional view along an O-O line of (a), according to the first embodiment of the present invention.
Figure 1:
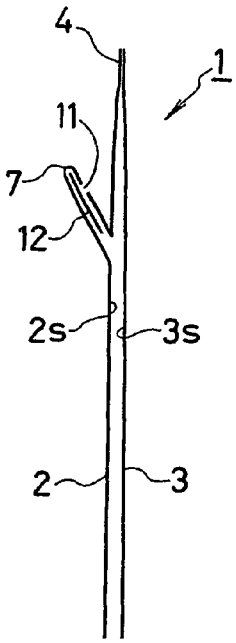

A packaging bag 1 according to the first embodiment of the present invention includes a front side main body film 2 and a back side main body film 3 which are respectively laminated films, are laid on, and as shown in FIG. 1(*b*), a bottom seal part 4 and both sides of side seal parts 5,5 are formed by thermal welding of edge parts circumference with thermal adhesive sealant layers 2*s*, 3*s* which are formed by lamination in inner surfaces of the laid-on films by heat-sealing so that contents, such as liquid or solid, can fill the bag 1.

As for the main body film 2 of the above mentioned front side, the front side main body film 2, by making parallel to the bottom seal part 4 at the bottom seal part 4 side across an entire width direction of the bag, is bent back toward the bottom seal part 4 side once, and a fold-in part 8 is provided in such a manner that the main body film 2, which is folded from a valley folding edge 6 to the bottom seal part 4 side, is made to be folded parallel to the bottom seal part 4 from a mountain folding edge 7 in the vicinity of the bottom seal part 4, and the fold-in part 8 is formed as the form which an inner sheet part 9 of an inside and an outer sheet 10 of an outside are combined to face respective thermal adhesive sealant layers 2*s* .

The above mentioned fold-in part 8 formed in the front side main body film 2 includes one steam venting port 11. The steam venting port 11 is positioned in the above mentioned inner sheet part 9. The steam venting port 11 may be provided as a small hole at the center of the inner sheet part or may be provided as a cutout or slit along the mountain folding edge 7.

Also, in an inside of the fold-in part 8 an easily peelable tape 12 having easily peelable property is inserted across an entire width of the bag in parallel to the fold-in part 8. One side of the easily peelable tape 12 is made as an easily peelable side 13 and the side 13 is positioned so as to face to the thermal adhesive sealant layer 2*s* of the above mentioned inner sheet part 9, and the other side is made as a high adhesive side 14 and the side14 is positioned so as to face to the thermal adhesive sealant layer 2*s* of the outer sheet part 10, and the required part is heat-sealed in the state that the easily peelable tape 12 is disposed between the inner sheet part 9 and the outer sheet part 10, and at the heat-sealed region, the easily peelable side 13 of the easily peelable tape 12 and the thermal adhesive sealant layer 2*s* of the inner sheet part 9 are thermally welded, and the high adhesive side 14 of the easily peelable tape 12 and the thermal adhesive sealant layer 2*s* of the outer sheet part 10 are thermally welded.

According to the embodiment of the present invention, the easily peelable tape 12 is heat-sealed across the entire width of the bag.

And in the region which the easily peelable side 13 of the easily peelable tape 12 and the heat adhesive sealant layer 2*s* of the inner sheet part 9 are thermally welded, the easily peelable tape 12 covers the steam venting port 11 by overlapping the steam venting port 11. Accordingly, the fold-in part 8 is provided to have the seal part 15 which closes the steam venting port 11.

A seal part 15 is formed by heat-sealing in the state which the inner sheet part 9 and the outer sheet part 10 are laid on placing the easily peelable tape 12 in between. See,e.g. FIG. 3 (*d*) . In the seal part 15, the high strength adhesive side 14 of the easily peelable tape 12 and the thermal adhesive sealant layer 2*s* of the outer sheet part 10 are thermally welded and a seal part to render delamination not imposible, even by the increased internal pressure which swells the bag, is formed between the easily peelable tape 12 and the outer sheet part 10, as will be described later. Also, in the seal part 15, the above mentioned easily peelable side 13 of the easily peelable tape 12 and the thermal adhesive sealant layer 2*s* of the inner sheet part 9 are thermally welded and the easily peelable seal part which delaminates as a result of the increased internal pressure which swells the bag, is formed between the easily peelable tape 12 and the inner sheet part 9. And the steam venting port 11 is positioned in the above mentioned easily peelable seal part.

Since the seal part 15 having the steam venting port 11 includes the above mentioned structure, the sealed packaging bag swells by a generation of steam in the inside of the bag, while cooking in the microwave oven, and when a force so as to separate the inner sheet part 9 and the outer sheet port 10 is added to the fold-in part 8, at the easily peelable seal portion in the seal part 15, the delamination between the inner sheet part 9 and the easily peelable tape 12 accelerates and the seal retracts to a mountain folding edge side of the fold-in part 8, accordingly the steam venting port 11 is opened, and the steam generated in the bag is released from the opened steam venting port 11, and no rupture of the bag occurs by keeping down the excessive increase of the internal pressure.

The above mentioned both sides of the fold-in part 8 are formed as the side seal parts 5 while fabricating a bag. And according to the first embodiment, at the side seal parts 5 of the fold-in part 8, the easily peelable tape 12 is positioned between the inner sheet part 9 and the outer sheet part 10, and the easily peelable side 13 of the easily peelable tape 12 at the corresponding position with the side seal parts 5, is also thermally welded to the thermal adhesive sealant layer 2*s* of the inner sheet part 9. However, when the internal pressure increases to expand the fold-in part 8, the opening of the above mentioned steam venting port 11 is performed earlier so that the steam venting port 11 is provided not to accelerate the delamination at the side seal parts 5.

According to the first embodiment, in order not to accelerate unnecessary delamination at both sides of the fold-in part 8, at side seal parts 5 thereof which are positioned in the opposite to the above mentioned bottom seal part side of the fold-in part 8 and which are made directly to heat-seal with the front and back main body films 2, 3, the extended side seal part is formed in the state of a part entered into the inner side. Accordingly, even in case that the bag is swollen, a force as a result of the increased inner pressure is difficult to apply to the fold-in part 8 and the side seal part respectively so that the extended side seal part is provided to avoid positively the delamination at the both sides of the side seal parts of the fold-in part 8.

As for the packaging bag 1, the edge of front and back main body films 2,3 which is apart from the fold-in part 8 locating facing to the bottom seal part 4 is a top intended part for heat seal 17 across the width of the bag and is made as the opening for contents filling use. And as for the packaging bag 1, in the side seal parts 5, at the height of the position in the vicinity of the bottom seal part 4, an easy cutting means 18 such as a cutout or a machine line and the like is provided. By providing the easy cutting means 18, the packaging bag as shown below can easily be torn to open without the use of cutting tools such as scissors and the like. Here, the easy cutting means 18 can be provided to the position at the height in the vicinity of the top intended part for heat seal 17.

(Package)

Figure 4:
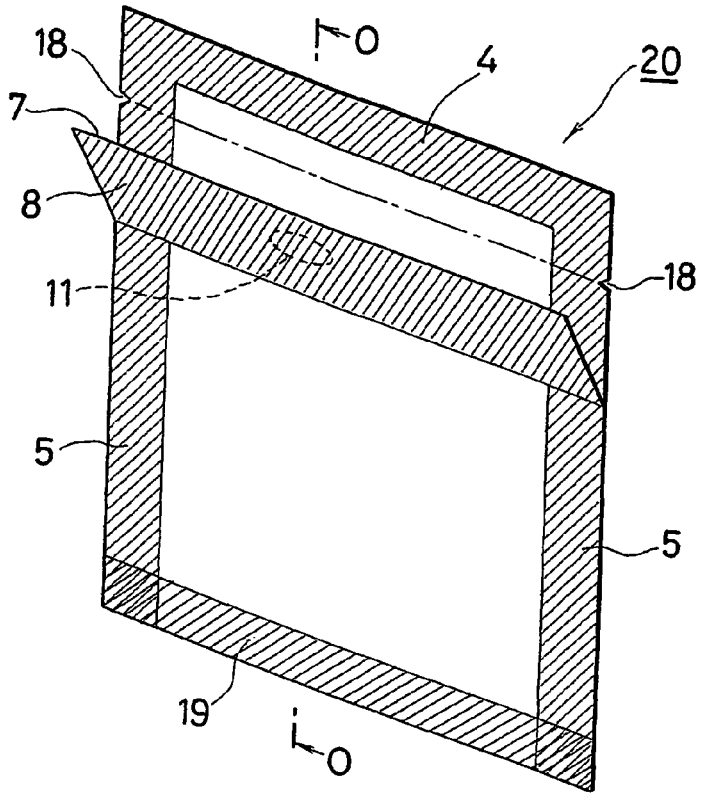
FIG. 4 illustrates a packaging bag according to the first embodiment of the present invention.
Figure 5:
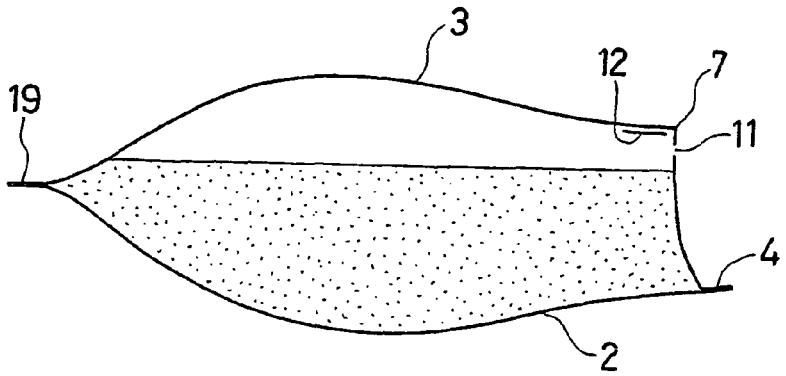
FIG. 5 illustrates an opened state of a steam venting port of a package according to the first embodiment of the present invention.

A package 20 which is heat-sealed at the top seal part 19 is obtained by filling contents from the opening of the top intended part for heat seal 17 of the above mentioned packaging bag 1 and by heat sealing the top intended part for heat seal 17 (FIG. 4). The package 20 is laid horizontally so as to face up the fold-in part 8 in the microwave oven and cooked, and when by the increase of temperature in the inside of the package, the bag is swollen by the swollen air or by the increase of pressure as a result of the generation of steam, as described above, the space between the inner sheet part 9 and the outer sheet part 10 opens at the fold-in part 8. And the delamination accelerates at the easily peelable seal part in the seal part 15, and in the state which the easily peelable tape 12 remains at the outer sheet part 10, the steam venting port 11 is opened (FIG. 5), and from the opened steam venting port 11 the steam is made to discharge to outward. Accordingly, the package 20 does not rupture and stain the inside of the microwave oven. Also, since the steam venting continues to perform appropriately, a pressure gradually drops and steaming effects and the like can be added to the cooking materials.

Here, as for the seal part 15, as describe above, before and after contents are filled into the bag, the steam venting port 11 is closed at room temperature (at normal atmosphere) of which the packaging bag is made.

(Base Layers for the Main Body Film)

Figure 2:
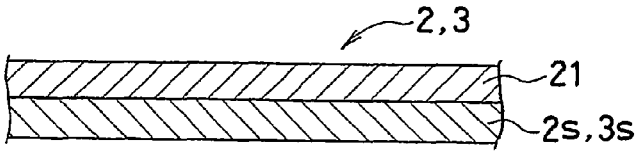
FIGS. 2(*a*) and 2(*b*) illustrate cross-sectional views of a main body film.
Figure 2:
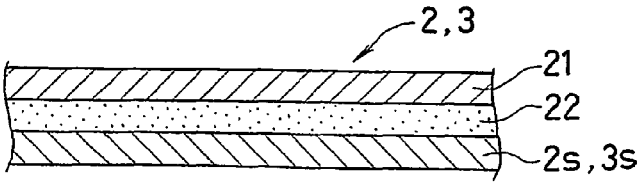

The above mentioned front and back main body films 2, 3 include a composite film made by laminating at least a base layer 21 and the above mentioned sealant layers 2*s*, 3*s* (Refer to FIG. 2(*a*)). The base layer 21 is film-like or sheet-like material and the plastic film or sheet having comparatively heat resistive property which is used for common packaging material, such as polyolefin (polyethylene, polypropylene and the like), polyester (polyethylene terephthalate, polybutylene terephthalate, polyethylene naphthalate and the like), polyamide (nylon-6, nylon-66, polyimide and the like) and their copolymers, can be used.

Also, for the base layer 21, the publicly known additives and if necessary, for example, antistatic agent, ultraviolet absorber, plasticizer, slipping agent, coloring agent and the like can be added appropriately. Moreover, the surface of the base layer 21 can be modified by a treatment such as corona discharge treatment or anchor coating treatment so that the adhesiveness can be improved with the above mentioned sealant layer. Also, if necessary, a printed layer (not shown in Figure) on the front or back side of the base layer can be provided.

Moreover, in order to improve gas barrier property of the main body films 2, 3 having the equivalent property with aluminum foil, an inorganic compound vapor deposition film provided by aluminum oxide or silica oxide vapor deposition by chemical vapor deposition or physical vapor deposition method for the thickness of approximately 20~100 nm, can also be used for the plastic film of the base layer 21. In the case of the plastic film, an oriented polyethylene terephthalate film can be preferably used.

(The Sealant Layer of the Main Body Film)

Resins having thermally welding property such as polyethylene, polypropylene, ethylene copolymer, saturated polyester and the like can be used as a sealant layer, and if the microwave oven suitability and the like is considered, propylene resin having thickness of approximately 60~80 μm can be preferably used.

In case that drop strength, thrust strength, or gas barrier property is required to improve, as shown in FIG. 2(*b*), an intermediate layer 22 can be made to locate between the base layer 21 and the sealant layers 2*s*, 3*s*. As the intermediate layer 22, for example, nylon film or polyester film and the like can be used preferably. Also, for the intermediate layer, the vapor deposition layer of inorganic compounds such as silica, aluminum oxide and the like can be contained.

The lamination of the base layer 21 and the sealant layers 2*s*, 3*s*, or the base layer 21 and the intermediate layer 22, or the intermediate layer 22 and the sealant layers 2*s*, 3*s* can be performed easily by the dry lamination method by use of, for example, two-pack polyurethane resin adhesive.

(Easily Peelable Tape)

The easily peelable film monolayer which is excellent in easily peelable property, and microwave oven operability is preferable to use for the easily peelable tape 12, and in more detail, 30 to 50 μm thick non-oriented polypropylene resin type easily peelable film manufactured by Toray Gosei Film Co., Ltd. or TOHCELLO Co., Ltd. is preferable to use.

(Packaging Bag Fabricating Process)

Figure 3:
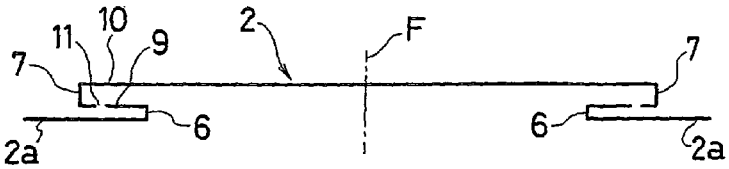
FIGS. 3(*a*)-3(*d*) illustrates a bag fabricating process of a packaging bag in order according to the first embodiment of the present invention.
Figure 3:
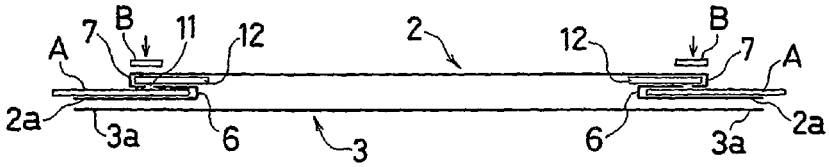
Figure 3:
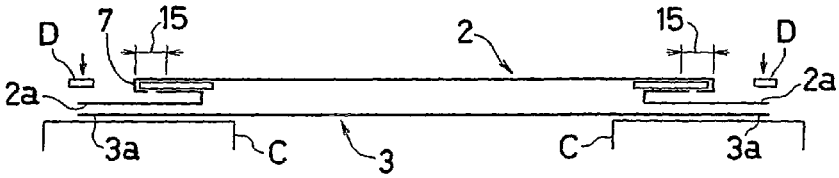
Figure 3:
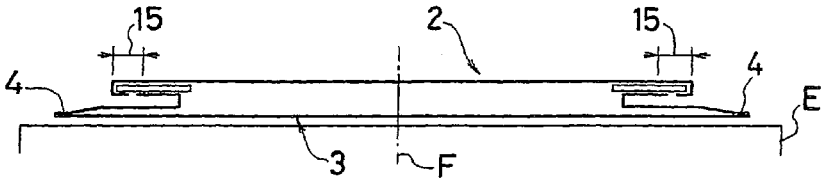

One example of the bag fabricating process of the above mentioned packaging bag 1 is illustrated according to FIGS. 3(*a*) to (*d*).

Initially, in FIG. 3(*a*), while the front side film 2 in a continuous form (as a wind roll form) is made for an unwinding and run in a horizontal direction (front and back direction in the Figure), the steam venting port 11 is formed in the region which becomes the inner sheet part, and then the fold-in part 8 is formed by obtaining the inner sheet part 9 and the outer sheet part 10 where the both sides edge parts 2*a*, 2*a* of the film width direction are folded back in reverse direction in turn mutually into V-letter shape in the position of the valley folding edge 6 and the mountain folding edge 7 by means of a folding guide plate (not shown in Fig.).

Continuously, the main body film 2 which formed the inner sheet part 9 and the outer sheet part 10 is made to the unwinding and run, and the easily peelable tape 12 in the continuous form is inserted horizontally between each inner sheet part 9 and outer sheet part 10, (front and back direction in Fig.) while the unwinding and run is made (to insert by way of facing the easily peelable side of the easily peelable tape 12 to the inner sheet part 9 side, and facing the high strength adhesive side facing to the outer sheet part 10 side), and the steam venting port 11 is made so as to be covered by the easily peelable tape 12.

Then, while the main body films 2,3 are made to the unwinding and run at the same speed, FIG. 3(*b*), masking shields A (heat masking shields) are inserted below the inner sheet parts 9 from the upper sides of each edge part 2*a*, 2*a* of the main body film 2. And, from the upper sides of the main body film 2 facing toward the portions where the easily peelable tapes 12 are situated, heat sealers B (long heat seal bars to film-run direction) are made to operate downward and are made to heat-seal by thermal press, in such a manner that the thermal adhesive sealant layers 2*s* of the inner sheet parts 9 and the easily adhesive sides of the easily peelable tapes 12 are thermally welded and also, in such a manner that the high strength adhesive sides of the easily peelable tapes 12 and the thermal adhesive sealant layers 2*s* of the outer sheet parts 10 are thermally welded.

Accordingly, the seal parts 15 are formed in the fold-in parts 8 which the inner sheet parts 9 and the outer sheet parts 10 having the easily peelable tapes 12 in between are made to face each other, and are formed in the state which the steam venting ports 11 are positioned to the easily peelable seal parts in the seal parts 15.

And then the above mentioned masking shields A are removed from the region of respective edge parts 2*a*, 3*a* of the main body films 2, 3, and after the main body films 2, 3 are temporally made to stop (or while making the unwinding run), as shown in FIG. 3(*c*), respective edge parts 2*a*, 3*a* of both edges of the width direction of the main body films 2, 3 are heat-sealed by the thermal press by operating downward the upper edge heat sealers D (long heat sealers to the film run direction) from the uppersides toward each receiving base C. Accordingly, respective edge parts 2*a*, 3*a* of both sides width direction of the main body films 2, 3 are heat-sealed to form the bottom seal part 4 shown in FIG. 1(*a*) to (*b*).

And then, side sealers provided to the direction perpendicular to the unwinding and run direction of the main body films 2, 3 (long and narrow heat seal bars to the film width direction including side seal width, not shown in Figure) are made to operate downward to the direction perpendicular to the unwinding and run direction of the main body films 2, 3 against a side seal receiving base E at even intervals to the unwinding direction, and the sealant layers 2*s*, 3*s* which face mutually at the side parts of the main body films 2, 3 and laid-on portions of the edge parts of the fold-in parts 8 (the portions which the inner sides of the inner side parts face to the easily peelable sides of the easily peelable tapes and which the high strength adhesive sides of the easily peelable tapes face to the inner sides of the outer sheet parts are thermally pressed.

Here, in the edge parts of the fold-in parts 8, the inner sides of the inner sheet parts 9 and the inner sides of the outer sheet parts 10 can be made so as to face each other directly, by providing through holes in the edge parts of the easily peelable tapes 12, or by providing the width sides of the easily peelable tapes 12 to smaller than the up-down size of the fold-in parts 8, and if such cases are provided, the portions are also heat-sealed by the above mentioned side sealer E.

To the laid-on main body films 2, 3 by this way, the side seal parts 5 are formed at even intervals to the perpendicular direction against the unwinding direction.

The inner sheet parts 9 in the main body film 2 are thermally pressed by the above mentioned side sealer in the laid-on state with the main body film 2 besides the fold-in parts 8, but the mutual facing surfaces of the main body film 2 of the bottom seal parts 4 side and the opposing above mentioned inner sheet parts 9, become the non-seal state which the side seals are not made, since the thermal adhesive sealant layers 2*s* made of a low melting point thermal adhesive resin are situated to the opposite side base layers (higher melting point than sealant layer 2*s* resin).

Accordingly, the main body films 2, 3 which are formed by heat seal are cut parallel to the film unwinding and run direction along the cutting line F of the central part of the film width direction as shown in FIG. 3(*d*), and the packaging bags 1 which open at the top intended parts for heat seal 17 are fabricated.

(The Second Embodiment of the Present Invention)

FIGS. 6 to 9 show the second embodiment of the present invention.

As for the examples, the seal part 15 is formed by heat-sealing throughout the upper line portion along the mountain folding edge 7 of the fold-in part 8 to the bag width direction. And the above mentioned seal part 15 has three non-seal parts 23 comprising non-seal region wherein one side is continuous to the mountain folding edge 7 and three sides are surrounded by the seal region and the above mentioned steam venting ports 11 are positioned at said non-seal parts 23. The steam venting ports 11 are cut into the inner sheet part 9, the easily peelable tape 12 and the outer sheet part 10 in the non-seal parts 23.

The above seal region is the portion which is heat-sealed all in one, as mentioned above where the easily peelable tape 12 is positioned between the inner sheet part 9 and the outer sheet part 10 in the seal part 15, and is the portion which the above mentioned easily peelable seal portion and the high strength adhesive seal portion are laid on. As mentioned above, the easily peelable seal portion is the heat-sealed portion in a state which the delamination is capable when the bag is swollen by the steam pressure, and the high strength seal portion is the heat-sealed portion in a state which the delamination is incapable even when the bag is swollen by the steam pressure. On the other hand, the non-heat seal region is made to be laid on in the seal part 15 in such a manner that the easily peelable tape 12 is situated between the inner sheet part 9 and the outer sheet part 10, but is a position which is not heat sealed. performed.

Also, according to the second embodiment of the present invention, the width size of the easily peelable tape 12 is provided to larger size than the height size along the perpendicular direction to the longitudinal direction of the fold-in part of the inner sheet part 9, and the high strength adhesive 14 side of a lower edge part 24 of the easily peelable tape 12 is thermally welded by heat seal to the thermal adhesive sealant layer 2*s* which is the inner side of the main body film 2 continuous to the outer sheet part 10 so that the delamination by steam pressure is in incapable state. The easily peelable side 13 at the lower edge part 24 of the easily peelable tape 12 does not face to the inner sheet part 9 and is in the non-adhesive state.

Also, in the both edge parts of the easily peelable tape 12, the high strength adhesive side 14 of the easily peelable tape 12 is heat-sealed to the outer sheet part 10 and the thermal adhesive sealant layer 2*s* of the main body film 2 of the contents filled part side which continues to the outer sheet part 10, while the easily peelable side 13 is heat-sealed to the thermal adhesive sealant layer 2*s* of the inner sheet part 9 and the thermal adhesive sealant layer 3*s* of the back side of the main body film 3.

Accordingly, also in the both sides of the side seal parts 5 of the fold-in part 8, the easily peelable side 13 of the easily peelable tape 12 has the portion which is thermally welded with the opposing side portion by heat-sealing, and when the bag is swollen, the above mentioned steam venting ports 11 are opened so that the seal retraction at the portion is provided so as not to occur and also, a device is made to avoid the seal retraction in accordance with the following structure.

Figure 6A:
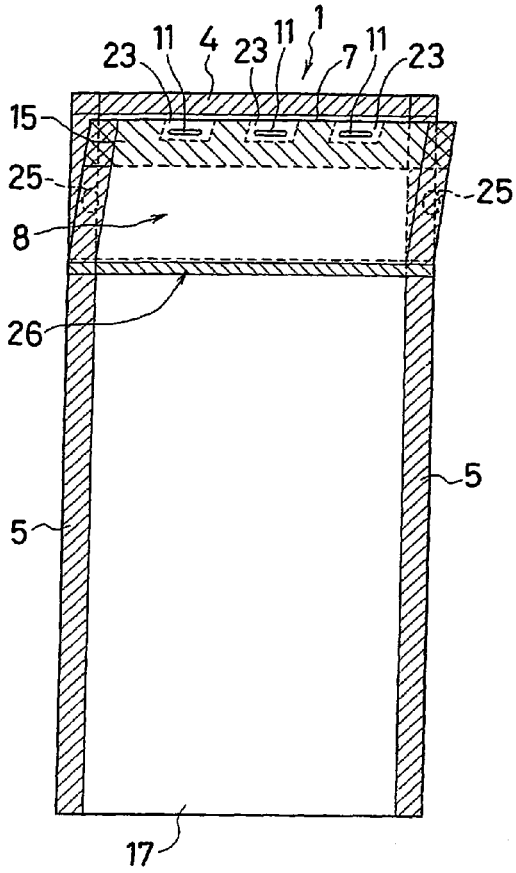
FIG. 6(*a*) illustrates a state of a perspective view, (b) illustrates a cross-sectional view along an O-O line of (a), (c) illustrates a cross-sectional view of a side seal part in a fold-in part, according to the second embodiment of the present invention.
Figure 6B:
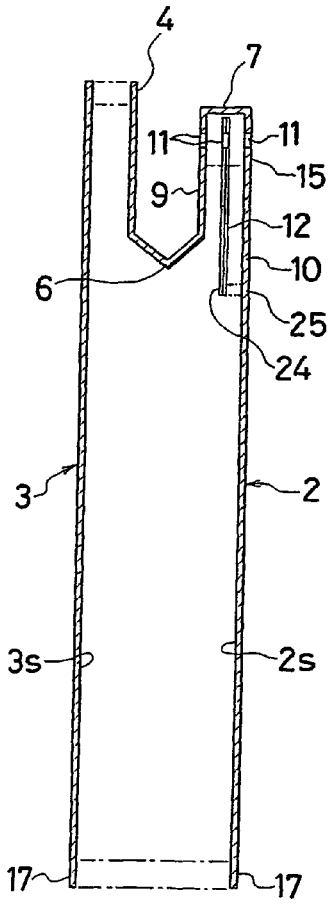
Figure 6C:
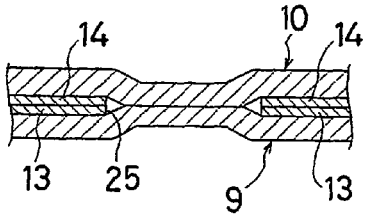

Accordingly, in the side seal parts 5 of the fold-in part 8, respective edge parts of the easily peelable tape 12 in the position are provided with punched holes 25 as shown in FIG. 6(*c*), and through the punched holes 25, the thermal adhesive sealant layers 2*s*, 2*s* of the inner sheet part 9 and the outer sheet part 10 are laid on each other under direct contact and are thermally welded by heat-sealing so that the seal retraction is made not to occur as described above. The shape of the punched holes 25 is not limited specifically, and in the portions situated at the side seal parts 5 of the fold-in part 8, the punched holes 25 are punched with one spot or more, with the shape of straight line or dotted line, for example, the punched holes 25 can be made to be punched in making straight line or dotted line in intermittently two or multiple spots.

Figure 7:
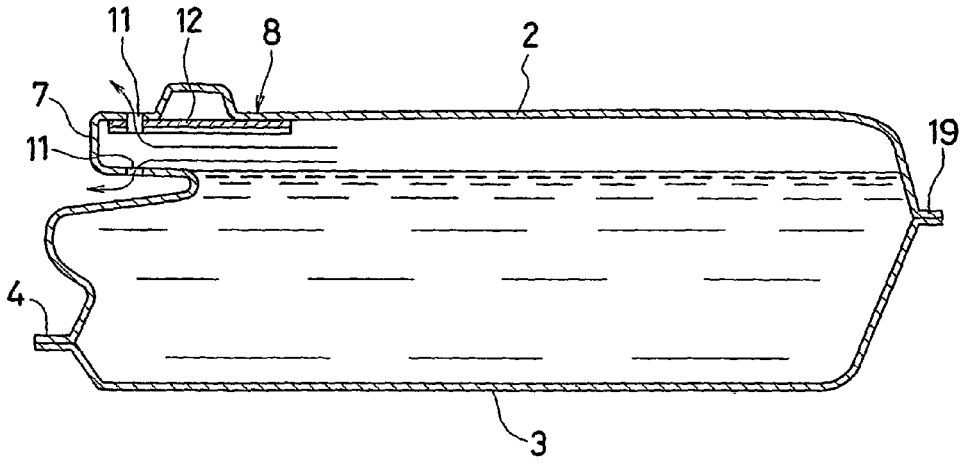
FIG. 7 illustrates an opened state of a steam venting port of a package according to the second embodiment of the present invention.

As for the packaging bag 1 according to the second embodiment of the present invention, the package 20 sealed at the top seal part 19 is obtained by heat-sealing the top intended part for heat seal 17 after contents are filled. And, when the package 20 is swollen by heating, as shown in FIG. 7, the fold-in part 8 is opened and the steam venting port 11 is opened and the steam can be released from the inner side.

(Packaging Bag Fabricating Process)

Figure 8:
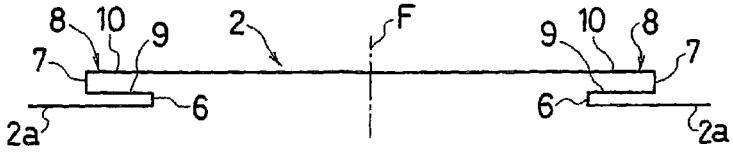
FIGS. 8(*a*)-8(*f*)illustrates a bag fabricating process of a packaging bag in order according to the second embodiment of the present invention.
Figure 8:
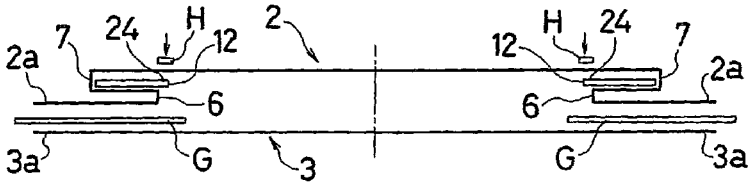
Figure 8:
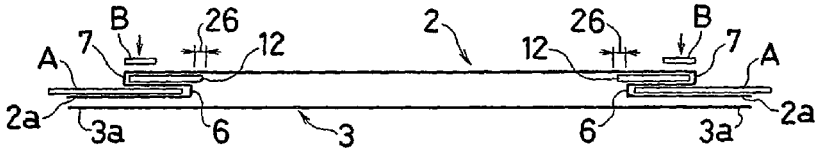
Figure 8:
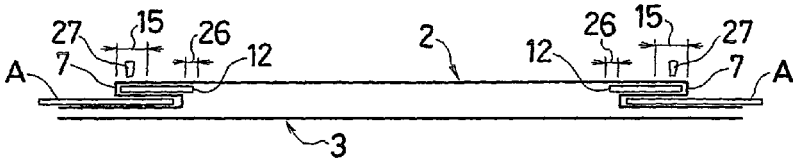
Figure 8:
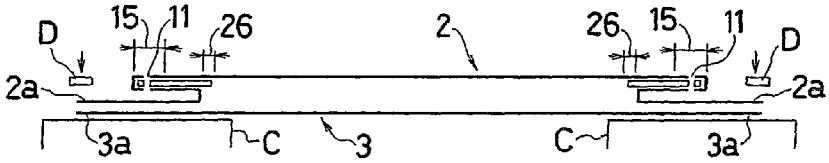
Figure 8:
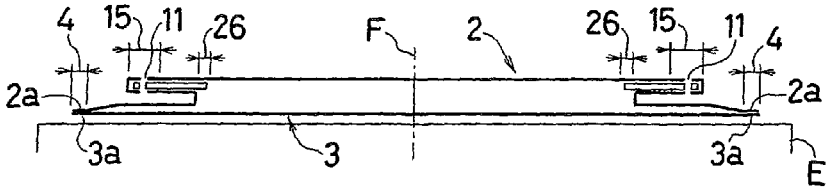

One example of the bag fabricating process of the above mentioned packaging bag 1 is illustrated according to FIGS. 8(*a*) to (*f*).

Initially, in FIG. 8(*a*), the fold-in parts 8 are formed by obtaining the inner sheet parts 9 and the outer sheet parts 10 where the two sides edge parts 2*a*, 2*a* of the film width direction are folded back in reverse direction in turn into V-letter shape in the positions of the valley folding edges 6 and the mountain folding edges 7 by means of a folding guide plate (not shown in Fig.), while the front side of film 2 in a continuous form (as a wind roll form) is made to the unwinding and run in a horizontal direction (front and back direction in Fig.), simultaneously.

And then, while the main body film 2 which formed the inner sheet parts 9 and the outer sheet parts 10 is made to the unwinding and run (FIG. 8(*a*)), to the under side of the main body film 2, the main body film 3 in the back side of the continuous form (the wind roll form) is made to the unwinding and run with the same run speed to the horizontal direction (front and back side direction in Figure) in adjusting with both edges parts 2*a*, 2*a* of the main body film 2, simultaneously, and the easily peelable tapes 12 in a continuous form are inserted into the space of each inner sheet part 9 and the outer sheet part 10 horizontally (front and back side direction in Figure) while making the unwinding and run. Here, in the positions which become the corresponding parts to the side seal parts 5 of the fold-in parts 8 of the easily peelable tapes 12, the above mentioned punched holes 25 are previously punched.

FIG. 8(*b*), simultaneously with the insertion of the easily peelable tapes 12, masking shields G (thermal resistive heat masking shields made of metal and the like) are inserted horizontally between respective edge parts 2*a*, 2*a* of the above mentioned main body film 2 and respective edge parts 3*a*, 3*a* of the back side of the main body film 3.

And after the main body films 2,3 are temporally made to stop (or while making the unwinding and run of the main body films 2, 3), from the upper side of the main body film 2 to the lower edge parts 24 of the easily peelable tapes 12, heat sealers H (long heat seal bars to the film run direction) are made to operate downward (or to make operating downward while removing at the same speed as the film run speed), and the sealant layer 2*s* of the main body film 2 and the lower edge parts 24 of the easily peelable tapes 12 are thermally pressed.

Accordingly, the high strength sides 14 of the lower edge parts 24 of the easily peelable tapes 12 are heat-sealed to the sealant layer 2*s* of the main body film 2 in incapable state of the delamination by the steam pressure, and the easily peelable sides 13 of the lower edge parts 24 of the easily peelable tapes 12 and the sealant layer 3*s* of the main body film 3 are not heat-sealed by the masking shields G so that lower part seal parts 26 are formed by keeping non-adhesive state. Here, according to the present invention, the formation of the lower part seal parts 26 can be omitted if necessary, and in that case, the fabrication process of the lower part seal parts 26 can be omitted.

And then, while the main body films 2, 3 are made to the unwinding and run in the same speed, FIG. 8(*c*), simultaneously, the masking shields A (the heat masking shield plates) are inserted from the upper side of respective edge parts 2*a*, 2*a* of the main body film 2 to under the inner sheet parts 9.

And from the upper side of the main body film 2 against the portions where the upper edge part of the easily peelable tapes 12 (the parts of the mountain folding edge sides) is situated, the heat sealers B (the long heat seal bars to the film run direction) are made to operate downward, and to heat-seal by thermal press in such a manner that the thermal adhesive sealant layer 2*s* of the inner sheet parts 9 and the easily peelable side 13 of the easily peelable tapes 12 are thermally welded, and also, in such a manner that the high strength adhesive side 14 of the easily peelable tapes 12 and thermal adhesive sealant layer 2*s* of the outer sheet parts 10 are thermally welded.

Accordingly, the seal parts 15 are formed to the fold-in parts 8 which the inner sheet parts 9 and the outer sheet parts 10 providing the easily peelable tapes 12 in between are made to face each other. In the seal parts 15, as mentioned above, the non-seal parts 23 are provided so as to continue to the mountain folding edges 7 at the positions of the center and right and left of the bag.

In the state which the above mentioned masking shields A are located, the steam venting ports 11 are provided to each of the above mentioned non-seal parts 23 by punching blades 27. Accordingly, the easily peelable seal parts in the seal parts 15 are in the state of surrounding respective steam venting ports 11.

And then, after the above mentioned masking shields A are removed from the region of respective edge parts 2*a*, 3*a* of the main body films 2, 3 and the main body films 2, 3 are temporally made to stop (or while making the unwinding run), as shown in FIG. 8(*e*), the upper edge heat sealers D (long heat-seal bars in the film run direction) are made to operate downward from the upper side of each edge 2*a*, 3*a* of width direction at both edges of the main body films 2, 3 to each receiving base C and heat-seal by thermally press. Accordingly, respective edge parts 2*a*, 3*a*, of the width direction at both edges of the main body films 2, 3 are heat-sealed and the bottom seal parts 4 are formed.

And then, FIG. 8(*f*), a side sealer (a long and narrow heat seal bar to the film width direction including a side seal width, not shown in the Figure.) which is provided in a direction perpendicular to the unwinding run direction of the main body films 2, 3, is made to operate downward to the side seal receiving base E in the direction perpendicular to the unwinding run direction of the main body films 2, 3 and to the unwinding run direction at even intervals, and thermally presses to the sealant layers 2*s*, 3*s* mutually facing to the side parts of the main body films 2, 3 and the laid-on parts of the edge parts of the fold-in parts 8 (the portions which the insides of the inner sheet parts face the easily peelable side of the easily peelable tapes and which the high strength adhesive sides of the easily peelable tapes faces to the insides of the outer sheet parts).

Here, at this point, in the edge parts of the fold-in parts 8, the inside of the inner sheet parts 9 and the inside of the outer sheet parts 10 are directly facing and are heat-sealed mutually by heat sealer E through the punched holes 25 of the edge parts of the easily peelable tapes 12.

Accordingly in the laid-on main body films 2, 3, the side seal parts 5 are formed at even intervals in the direction perpendicular to the unwinding direction.

Accordingly the main body films 2, 3 which are formed by heat-sealing, as shown in FIG. 8(*f*), are cut in parallel to the film unwinding run direction along a cutting line F at the center part of the film width direction and the packaging bags 1 which open at the positions of the top intended parts for heat seal 17 are fabricated as the bags.

Figure 9A:
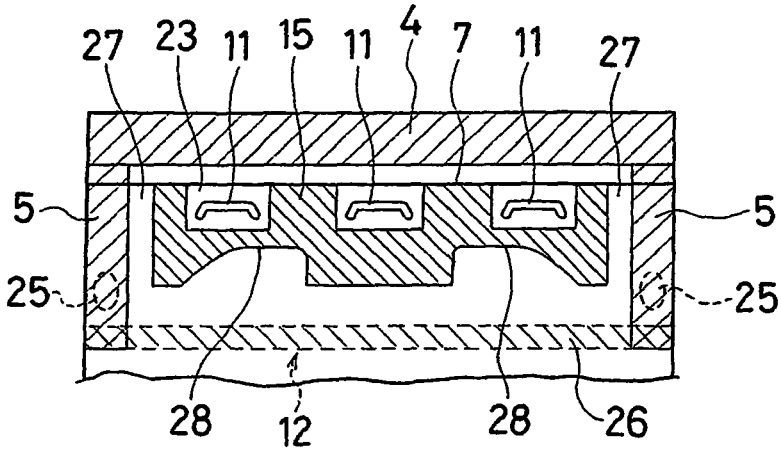
FIGS. 9(*a*)-(*b*) illustrates modification examples of a seal part according to the second embodiment of the present invention.
Figure 9B:
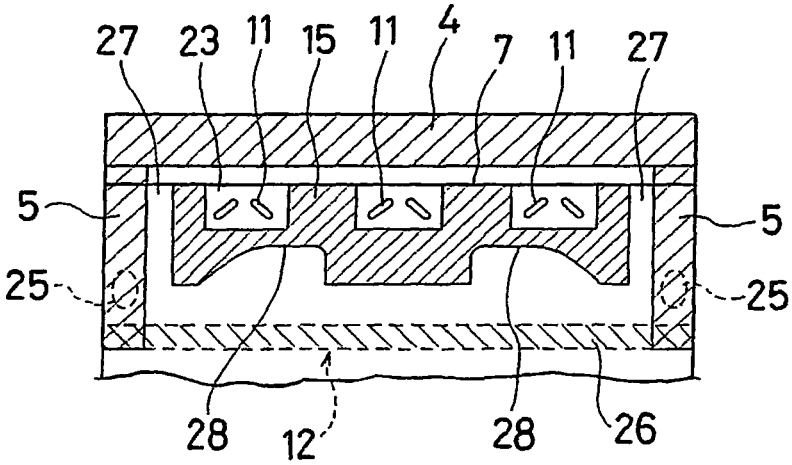
Figure 10A:
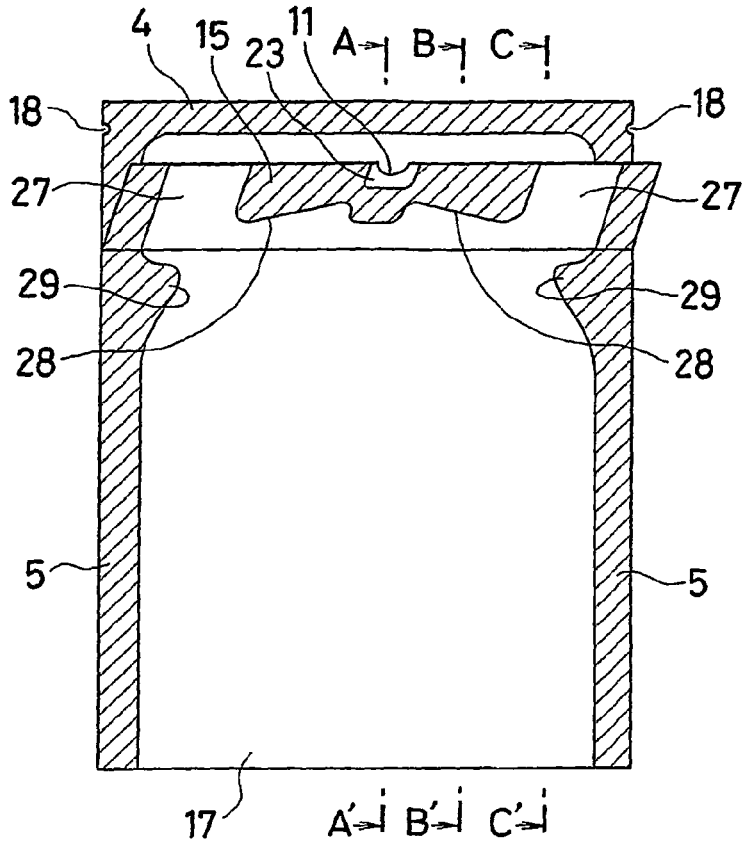
FIG. 10(*a*) illustrates a state of a front view, schematically, (b) illustrates a cross-sectional view along an A-A' line of (a), (c) illustrates a cross-sectional view along a B-B' line of (a), (d) illustrates a cross-sectional view along a C-C' line of (a), according to the third embodiment of the present invention.
Figure 10B:
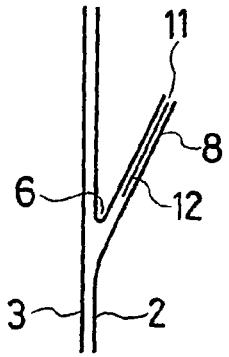
Figure 10C:
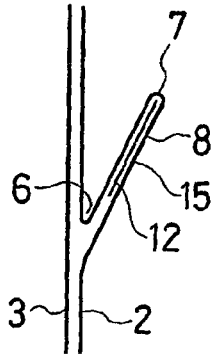
Figure 10D:
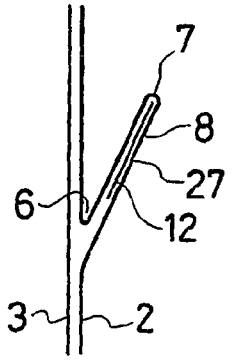

According to the illustrated embodiment of the present invention, the seal parts 15 are formed so as to continue to the regions of the side seal parts 5, and as shown in FIG. 9(*a*), at both edges of the seal parts 15, the non-seal parts 23, which are a line symmetry in making the vertical central line 0 of the packaging bag 1 as an axis of symmetry and which are not heat sealed, may be provided.

Also, lower lines of the seal parts 15 may be acceptable as forms which provide declining lines 28 to be the forms which project upward in the line symmetry making the vertical central line 0 of the packaging bag 1 as an axis of symmetry, in such a manner that the steam which is generated in the bag flows smoothly toward the steam venting ports 11.

Also, the shapes of the above mentioned steam venting ports 11, as shown in FIG. 9(*a*), can be nearly as a square shape one side open which include oblique or vertical downward short straight lines in the both edges of the straight line shape in parallel to the straight line of the mountain folding edge 7 or can be nearly as a mountain folding shape or nearly a circular arc shape which projects to the above mentioned straight line, or as shown in FIG. 9(*b*), can be oblique lines, as tapered double lines. An oblong shape, ellipse shape besides narrow line slit shape (or extremely narrow line slit shape) as a pierce providing a hole, can be acceptable for the steam venting ports 11 if necessary. Also, the non-seal parts 23 of the above mentioned steam venting ports 11 are not always required.

(The Third Embodiment of the Present Invention)

FIG. 10(*a*)-(*b*) shows the third-embodiment of the present invention. According to the embodiment, at the center of the fold-in part 8, the seal part 15 is formed so as to continue to the mountain folding edge 7, and is made as a discontinuous state with both sides of side seal parts 5 through the non-seal part 27 in the fold-in part 8. Also, the above mentioned seal part 15 has the non-seal part 23 so as to continue to the mountain folding edge 7, and at the non-seal part 23, the steam venting port 11 is formed as a cutout type. Moreover, the right and left lower lines of the lower line of the seal part 15 are made as the oblique lower lines 28.

And as shown in FIG. 10(*a*), the side seal parts 5 which are located adjacent to the fold-in part 8 and the opposite side of the bottom seal part 4 are provided by the extended seal parts 29 which are extended toward the central side of the bag. Since the extended seal parts 29 are provided in such a way, when the package obtained from the packaging bag 1 is cooked, the steam flow is guided to the steam venting port 11 side so that the pressure makes it difficult to apply to the both sides of the side seal part of the fold-in part 8. Also, since the side seal parts 5 are made to be partly wide, temperature increase of the extended seal parts 29 is so low that the extended seal parts 29 as the picking-up parts, are able to be picked up with finger tips even immediately after the bag is cooked by the microwave oven.

(The Fourth Embodiment of the Present Invention)

Figure 11A:
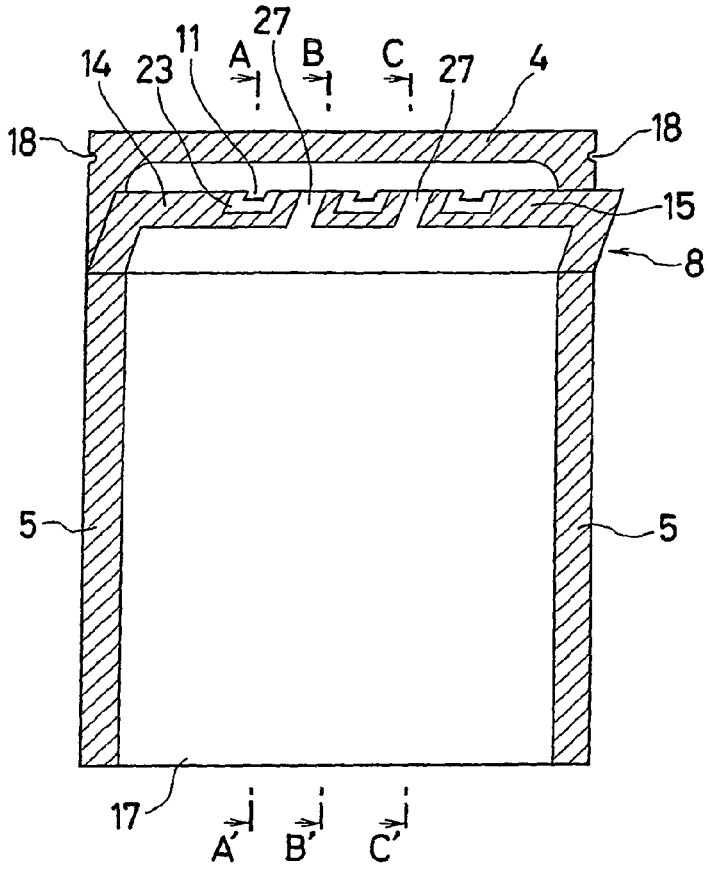
FIG. 11(*a*) illustrates a state of a front view, schematically, (b) illustrates a cross-sectional view along an A-A' line of (a), (c) illustrates a cross-sectional view along a B-B' line of (a), (d) illustrates a cross-sectional view along a C-C' line of (a), according to the fourth embodiment of the present invention.
Figures 11B, 11C, 11D:
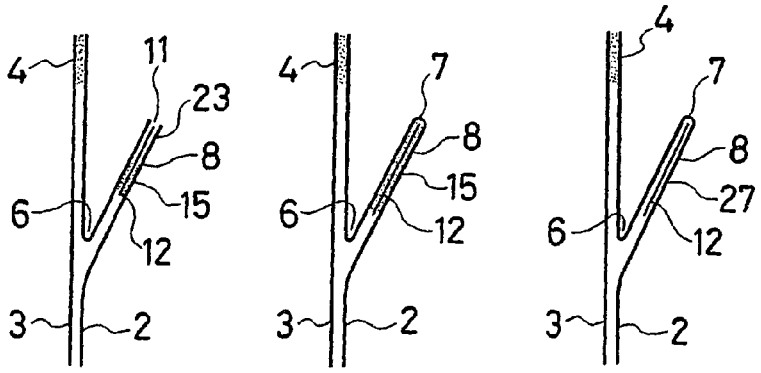

FIGS. 11(*a*)-(*b*) shows the fourth embodiment of the present invention. According to the embodiment, in the center and right and left sides of the fold-in part 8, three seal parts 15 are formed so as to continue to the mountain folding edges 7, and the right and left seal parts 15 are made in a continuous state with both sides of the side seal parts 5 in the fold-in part 8. Also, the above mentioned seal parts 15 have the non-seal parts 23 so as to continue to the mountain folding edges 7 where in the non-seal parts 23 the steam venting ports 11 are formed as a cutout type. Moreover, the seal part 15 at the central position and the seal parts 15 at the right and left, are provided in the discontinuous state through the non-seal parts 27, and each steam venting port 11 and the above mentioned non-seal parts 27 are made to be adjacent. Accordingly, the opening of each steam venting port 11 can be conducted satisfactorily even with multiple steam venting ports 11.

(The Fifth Embodiment of the Present Invention)

Figure 12A:
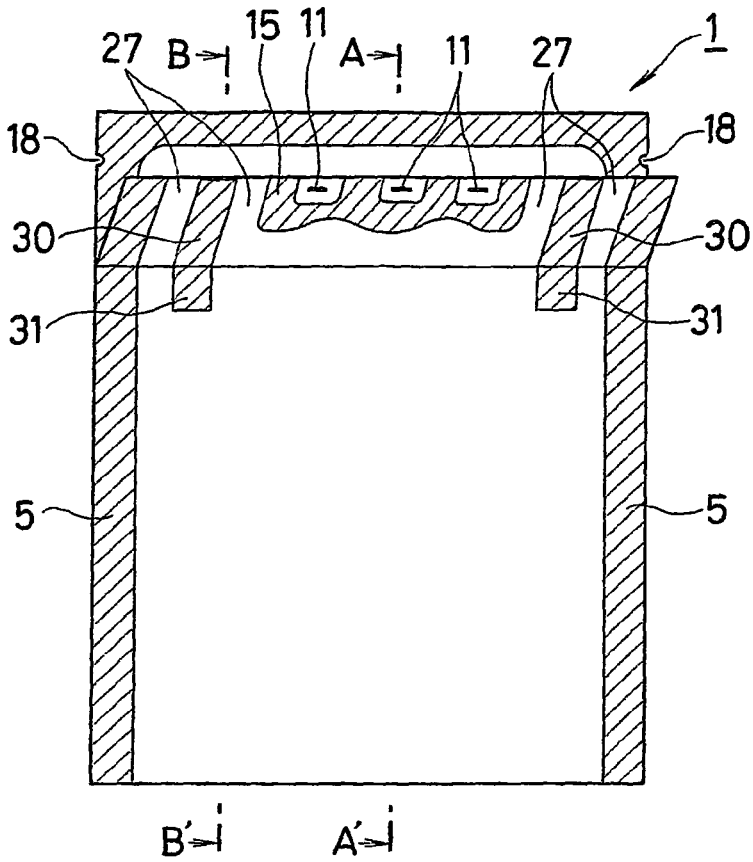
FIG. 12(*a*) illustrates a state of a front view, schematically, (b) illustrates a cross-sectional view along an A-A' line of (a), and (c) illustrates a cross-sectional view along a B-B' line of (a), according to a modification of the fourth embodiment of the present invention.
Figure 12B:
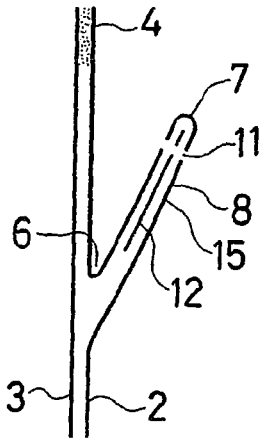
Figure 12C:
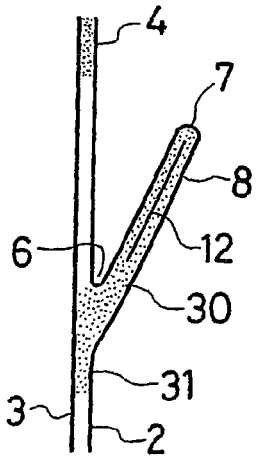
Figure 13A:
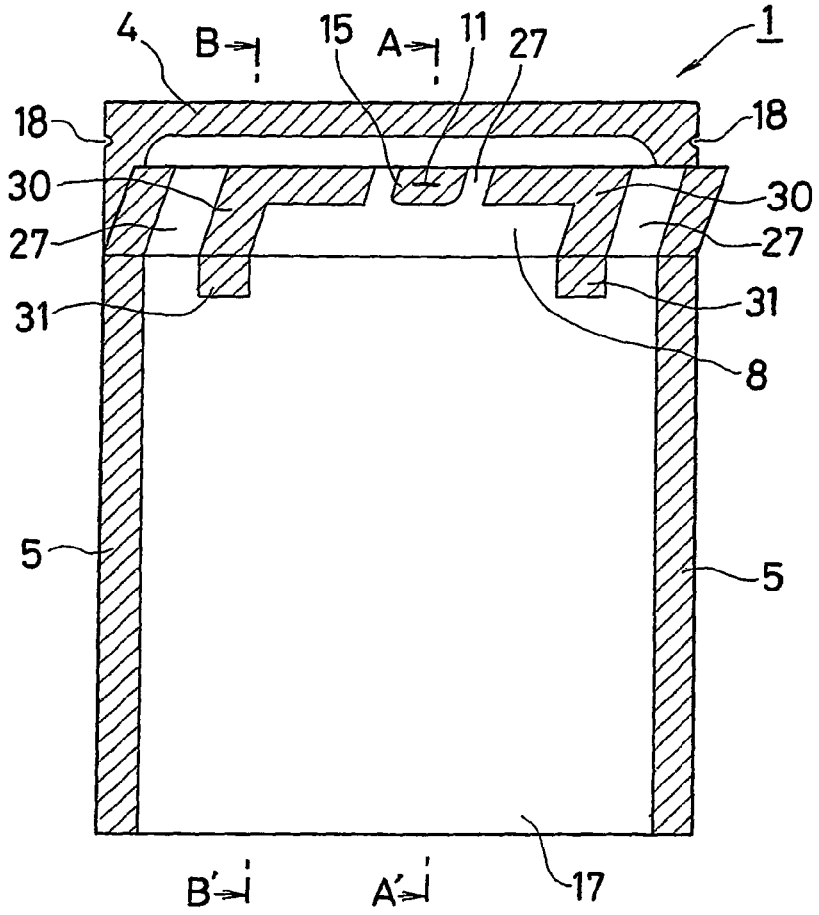
FIG. 13(*a*) illustrates a state of a front view, schematically, (b) illustrates a cross-sectional view along an A-A' line of (a), and (c) illustrates a cross-sectional view along a B-B' line of (a), according to the fifth embodiment of the present invention.
Figure 13B:
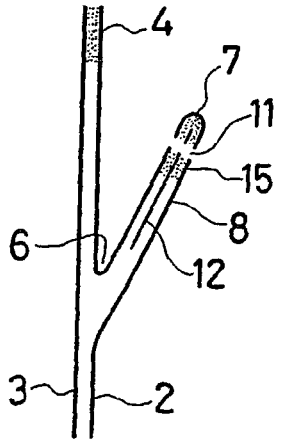
Figure 13C:
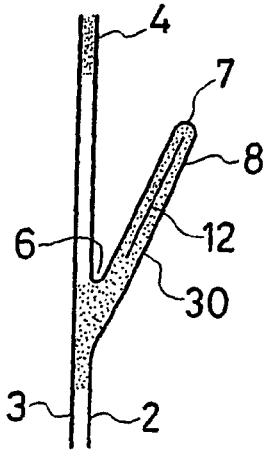

FIG. 12 and FIG. 13 show the fifth embodiment. According to the embodiment, the lateral side seal parts 30 are formed by interposing the central seal part 15 of the fold-in part 8 between the right side and left side. The above mentioned side seal parts 30 are made by heat-sealing the fold-in part 8 so as to continue to the mountain folding edge 7 with a longitudinal direction of the fold-in part 8 extending in a perpendicular direction, and continue to the seal parts 31 which are made by heat-sealing of the front and back of the main body films 2, 3 in the filling region with the opposite side of the bottom seal part 4 of the fold-in part 8. The lateral side seal parts 30 are provided in the line symmetry with making the packaging bag vertical line as an axis of symmetry. Also, the above mentioned lateral side seal parts 30 can be made to have the horizontal part along the mountain folding edge 7 as shown in FIGS. 12 and 13.

Accordingly, by providing the lateral side seal parts 30, while the package filled with contents is cooked by the microwave oven and the like, the swell is held down by side seal parts 30 even if the package swells by the internal pressure of generated steam and the like so that the seal retraction of both sides of the fold-in part 8 can be prevented.

(The Sixth Embodiment of the Present Invention)

Figure 14A:
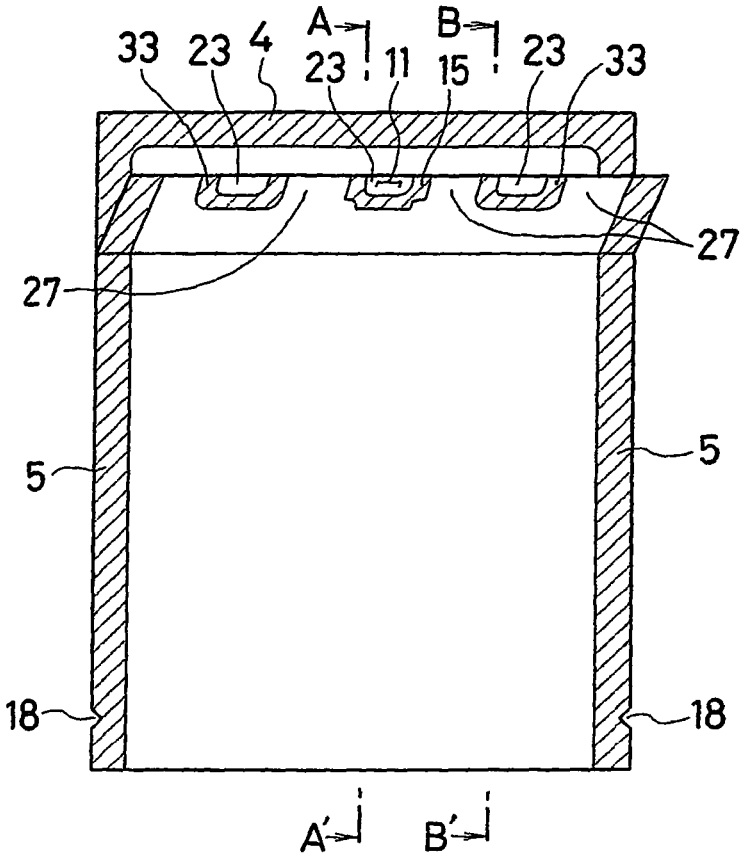
FIG. 14(*a*) illustrates a state of a front view, schematically, (b) illustrates a cross-sectional view along an A-A' line of (a), and (c) illustrates a cross-sectional view along a B-B' line of (a), according to the sixth embodiment of the present invention.
Figure 14B:
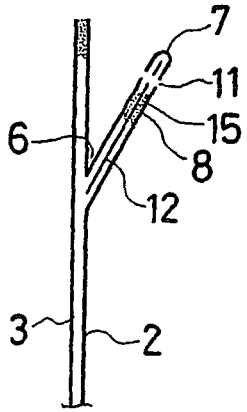
Figure 14C:
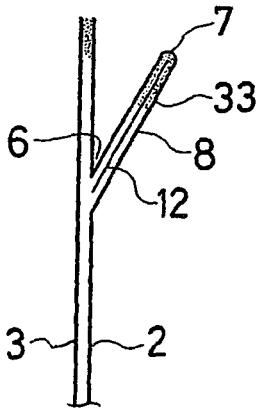
Figure 15:
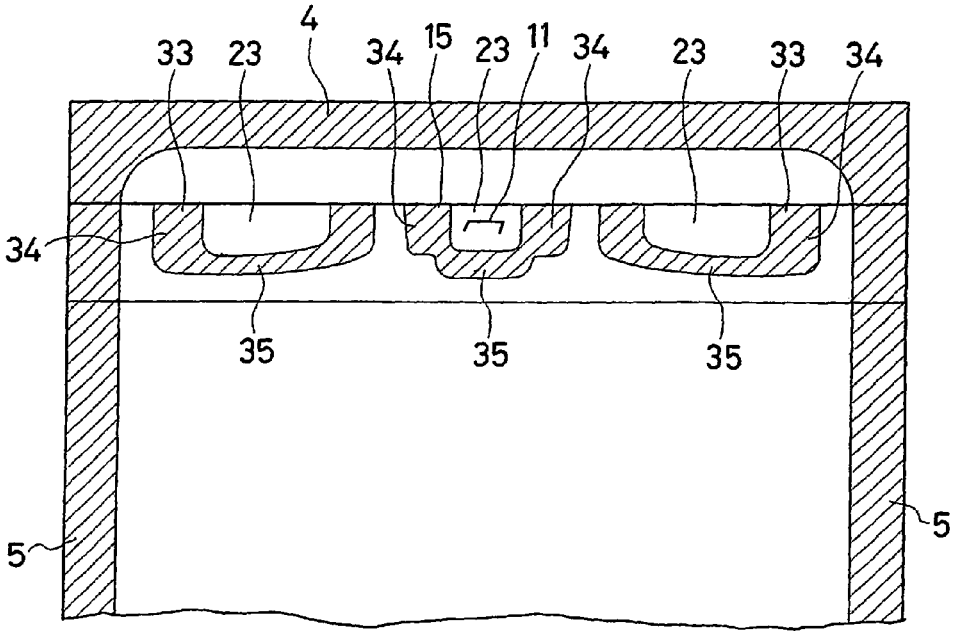
FIG. 15 illustrates a fold-in part according to the sixth embodiment of the present invention.

FIG. 14 and FIG. 15 show the sixth embodiment of the present invention. According to the embodiment, the non-seal parts 23 are located in the center of the fold-in part 8, and the steam venting port 11 is positioned in the non-seal part 23 and the seal part 15 is provided to be a convex facing against opposite side to the mountain folding edge 7, and further, the lateral side seal parts 33 including the non-sealing part 23 at both sides of the central seal part 15 are provided side by side through the non-seal parts 27.

And in the above mentioned central seal part 15, the seal width at the width direction of the bag of the vertical parts 34 continuous to the mountain folding edge 7 of the seal region is provided to be larger than the seal width at the perpendicular direction to the width direction of the bag of the horizontal part 35 along the width direction of the bag of the seal region. In the manner, the seal retraction is held down by the vertical parts 34 at the seal part 15 even if the bag is swollen and the flow of the steam is made in capable to control.

Moreover, in respective lateral side seal parts 33, the vertical parts 34 of the side seal part side of the seal region are provided to extend to the opposite side to the mountain folding edge 7, and the horizontal parts 35 of the seal region are inclined so as to lean to the opposite side with the mountain folding edge as approaching from the seal parts 15 sides to the side seal parts 5 sides. In this manner, when the bag is swollen, the swell shifts to the central seal parts 15 sides and can be made not to shift to the side seal parts 5 sides.

(The Seventh Embodiment of the Present Invention)

Figure 16A:
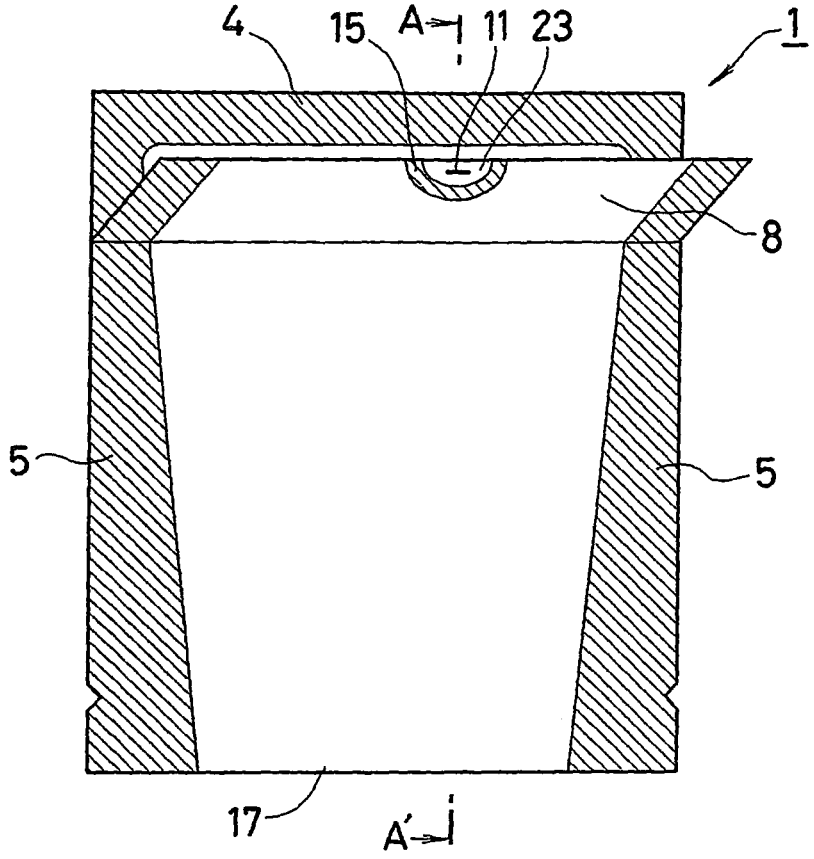
FIG. 16(*a*) illustrates a state of a front view, schematically, (b) illustrates a cross-sectional view along an A-A' line of (a) according to the seventh embodiment of the present invention.
Figure 16B:
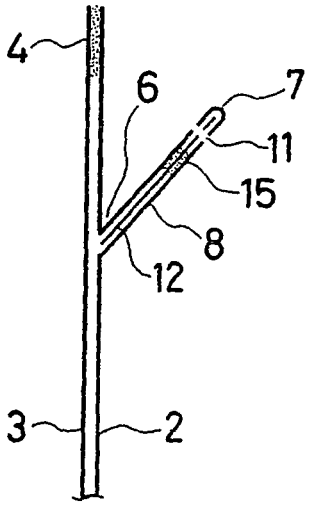
Figure 17A:
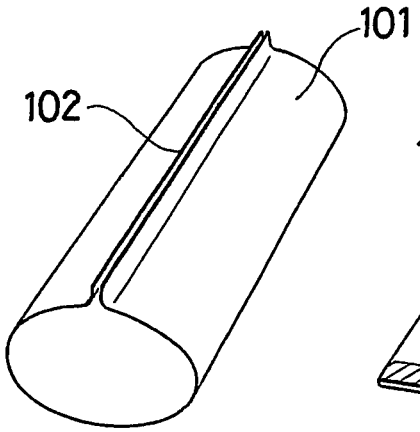
FIGS. 17 (*a*)-17 (*c*)illustrate conventional examples.
Figure 17B:
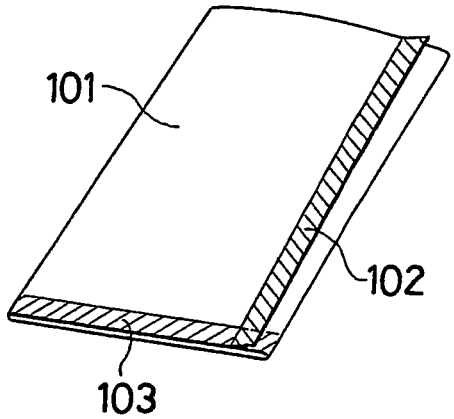
Figure 17C:
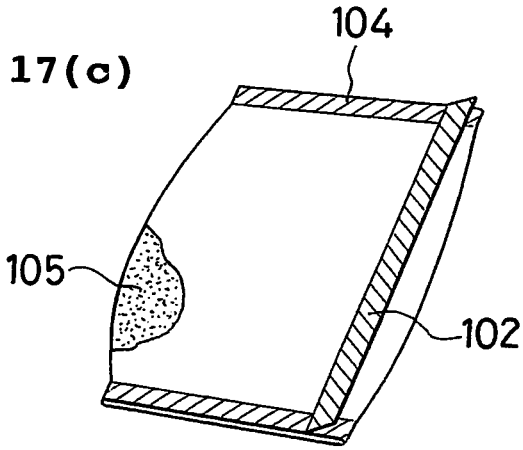

FIGS. 16(*a*) and (*b*) shows the seventh embodiment of the present invention. According to the embodiment, the seal width of the side seal parts 5 is made to change across the length direction of the side seal part. Namely, the seal width of the side seal parts 5 in the vicinity of the bottom seal part 4 is made to be narrower than the seal width of the side seal parts 5 in the vicinity of the top intended part for heat seal 17 in the opposing position of the bottom seal part 4. Accordingly, the seal width of the side seal part 5 is made to be gradually broader from the vicinity of the bottom seal part 4 to the vicinity of the heat seal 17.

By this means, even if the package is swollen by heating, the center of swelling is made so as to slide to the fold-in part 8 side, and even if the top seal part is made to be the impurities seal state, the seal retraction at the top seal part can be prevented.

EXAMPLE 1

A packaging bag and a package were fabricated according to the embodiment shown in FIGS. 1 to 5.

And then, a fold-in part 8 by folding a front side of a main body film 2 into two at a folding line situated nearer to the outside edge in relation to center to a width direction, was formed, and simultaneously, a small hole was punched as a steam venting port 11 around nearby center in the vicinity of a mountain folding edge 7 of an inner sheet part 9 of the front side main body film 2 which was to fold into two for the fold-in part 8.

As an easily peelable tape 12, an easily peelable film for retort use, CMPS 013C (Manufactured by TOHCELLO CO., LTD) (thickness 50 μm) which was cut to a tape form with nearly the same width of a fold-in part, was prepared, separately.

And then, a fold-in part 8 by folding a front side of a main body film 2 into two at a folding line situated nearer to the outside edge in relation to center to a width direction, was formed, and simultaneously, a small hole was punched as a steam venting port 11 around nearby center in the vicinity of a mountain folding edge 7 of an inner sheet part 9 of the front side main body film 2 which was to fold into two for the fold-in part 8.

An appropriate width of the easily peelable tape 12 was thermally welded to the entire width along the mountain folding edge 7 in the space of sealant layer 2*s* of the fold-in part 8. In that case, the steam venting port 11 was covered with the easily peelable film 12.

And a seal part 15 was formed by heat-sealing the fold-in part 8.

The front side main body film 2 and a back side main body film 3 were laid on facing the mutual sealant layers 2*s*, 3*s*, and a bottom side and both sides in the vicinity of the fold-in part 8 were thermally welded to provide a bottom seal part 4 and side seal parts 5, respectively, so that a packaging bag 1 having the steam venting function was able to be fabricated.

An appropriate amount of water was filled into the packaging bag 1 and a package 20 was made by heat sealing a top intended part for heat seal 17, and the package 20 was laid horizontally with facing up the fold-in part 8 which the easily peelable tape 12 was thermally welded, and was heated by a microwave oven.

The internal pressure was raised with heating, the packaging bag began to swell, and the steam venting port 11 opened by retraction of an easily peelable seal portion of the seal part 15 so that the steam in the inside was released by leaking to outside, and the package 20 did not break. Also, the contents did not leak.

EXAMPLE 2

A packaging bag and a package were made according to the embodiment shown in FIG. 10.

As a front side main body film and a back side main body film, a composite film was prepared with a layer structure, providing aluminum oxide vapor deposition polyethylene terephthalate film (thickness 12 μm)(base layer)/biaxially oriented nylon film (thickness 15 μm)(intermediate layer)/non-oriented polypropylene film (thickness 80 μm)(sealant layer).

As an easily peelable tape 12, an easily peelable film for retort CMPS 013C (Manufactured by TOHCELLO CO., Ltd.) (thickness 50 μm) which was cut to a tape form with nearly the same width of a fold-in part was prepared, separately.

And then, a fold-in part 8 was formed by folding a front side of the main body film 2 into two at a folding line situated nearer the outside edge in relation to center to a width direction.

The same width with the fold-in part of the easily peelable tape 12 was thermally welded, along a mountain folded edge 7 in the space of a sealant layer 2*s* of the fold-in part 8, and in a non-seal part 23 a steam venting port 11 was formed as a small hole after the seal part was formed.

The front side main body film 2 and a back side main body film 3 were laid on facing the mutual sealant layers 2*s*, 3*s*, and a bottom side and both sides in the vicinity of the fold-in part 8 were thermally welded to provide a bottom seal part 4 and side seal parts 5, respectively so that a packaging bag 1 having the steam venting function was able to be fabricated.

An appropriate amount of water was filled into the packaging bag 1 and a package 20 was made by heat sealing a top intended part for heat seal 17, and the package 20 was laid horizontally with facing up the fold-in part 8 which the easily peelable tape 12 was thermally welded, and the heated by a microwave oven.

The internal pressure was raised with heating, the packaging bag began to swell, and the steam venting port 11 opened by retraction of an easily peelable seal portion of the seal part 15 so that the steam in the inside was released by leaking to outside, and the package 20 did not break. Also, the contents did not leak.

EXAMPLE 3

A packaging bag and a package were made according to the embodiment shown in FIG. 11.

As a front side main body film and a back side main body film, a composite film was prepared with a layer structure, providing aluminum oxide vapor deposition polyethylene terephthalate film (thickness 12 μm)(base layer)/biaxially oriented nylon film (thickness 15 μm)(intermediate layer)/non-oriented polypropylene film (thickness 80 μm)(sealant layer).

As an easily peelable tape 12, an easily peelable film for retort CMPS 013C (Manufactured by TOHCELLO CO., Ltd.) (thickness 50 μm) which was cut to a tape form with nearly the same width of a fold-in part was prepared, separately.

And then, a fold-in part 8 was formed by folding a front side of the main body film 2 into two at a folding line situated nearer the outside edge in relation to center to a width direction.

The same width with the fold-in part of an easily peelable tape 12 was made to be thermally welded along a mountain folding edge 7 in the space of sealant layer 2*s* of the fold-in part 8, and after the three seal parts 15 were made to mutually discontinuous pattern and are formed, in a non-seal part 23 of each seal part 15, a steam venting port 11 was formed as a small hole.

The front side main body film 2 and a back side main body film 3 were laid on facing the mutual sealant layers 2*s*, 3*s*, and a bottom side and both sides in the vicinity of the fold-in part 8 were thermally welded to provide a bottom seal part 4 and side seal parts 5, respectively, so that a packaging bag 1 having the steam venting function was able to be fabricated.

An appropriate amount of water was filled into the packaging bag 1 and a package 20 was made by heat sealing the top intended part for heat seal 17, and the package 20 was laid horizontally with facing up the fold-in part 8 which the easily peelable tape 12 was thermally welded, and was heated by a microwave oven.

The internal pressure was raised with heating, the packaging bag began to swell, and the steam venting port 11 opened by retraction of easily peelable seal portion of the seal part 15 so that the steam in the inside was released by leaking to outside, and the package 20 did not break. Also, the contents did not leak.

EXAMPLE 4

A packaging bag and a package are made according to the embodiment shown in FIG. 12, FIG. 13.

As a front side main body film and a back side main body film, a composite film was prepared with a layer structure, providing aluminum oxide vapor deposition polyethylene terephthalate film (thickness 12 μm)(base layer)/biaxially oriented nylon film (thickness 15 μm)(intermediate layer)/non-oriented polypropylene film (thickness 80 μm)(sealant layer).

As an easily peelable tape 12, an easily peelable film for retort CMPS 013C (Manufactured by TOHCELLO CO., Ltd.) (thickness 50 μm) which was cut to a tape form with nearly same width of a fold-in part was prepared, separately.

And then, a fold-in part 8 was formed by folding a front side of the main body film 2 into two at a folding line situated nearer the outside edge in relation to center to a width direction.

The same width with the fold-in part of an easily peelable tape 12 is thermally welded, along a mountain folding edge 7 in the space of sealant layer 2*s* of the fold-in part 8, and after seal parts 15 and a lateral side seal part 31 are made to discontinuous pattern mutually and are formed, in a non-seal part 23 of each seal part 15 a steam venting port 11 was formed as a small hole.

The front side main body film 2 and a back side main body film 3 were laid on facing the mutual sealant layers 2*s*, 3*s*, and a bottom side and both sides in the vicinity of the fold-in part 8 were thermally welded to provide a bottom seal part 4 and side seal parts 5, respectively, so that a packaging bag 1 having the steam venting function was able to be fabricated.

An appropriate amount of water was filled into the packaging bag 1 and a package 20 was made by heat sealing a top intended part for heat seal 17, and the package 20 was laid horizontally with facing up the fold-in part 8 which the easily peelable tape 12 was thermally welded, and was heated by a microwave oven.

The internal pressure was raised with heating, the packaging bag began to swell, and the steam venting port 11 opened by retraction of easily peelable seal portion of a the seal part 15 so that the steam in the inside was released by leaking to outside, and the package 20 did not break. Also, the contents did not leak.

EXAMPLE 5

A packaging bag and a package were made according to the embodiment shown in FIG. 14, FIG. 15.

As a front side main body film and a back side main body film, a composite film was prepared with a layer structure, providing aluminum oxide vapor deposition polyethylene terephthalate film (thickness 12 μm)(base layer)/biaxially oriented nylon film (thickness 15 μm)(intermediate layer)/non-oriented polypropylene film (thickness 80 μm)(sealant layer).

As an easily peelable tape 12, an easily peelable film for retort CMPS 013C (Manufactured by TOHCELLO CO., Ltd.) (thickness 50 μm) which was cut to tape form with nearly same width of a fold-in part is prepared, separately.

And then, a fold-in part 8 was formed by folding a front side of the main body film 2 into two at a folding line situated nearer the outside edge in relation to center to a width direction.

The same width with the fold-in part of an easily peelable tape 12 is thermally welded, along a mountain folded edge 7 in the space of sealant layer 2*s* of the fold-in part 8, and after a seal part 15 and the right and left of a lateral side seal part 33 are made to mutually discontinuous pattern and were formed, in a non-seal part 23 of each seal part 15 a steam venting port 11 was formed as a small hole.

The front side main body film 2 and a back side main body film 3, were laid on facing the mutual sealant layers 2*s*, 3*s*, and a bottom side and both sides in the vicinity of the fold-in part 8 were thermally welded to provide a bottom seal part 4 and the side seal parts 5, respectively, so that a packaging bag 1 having the steam venting function was able to be fabricated.

An appropriate amount of water was filled into the packaging bag 1 and a package 20 was made by heat sealing a top intended part for heat seal 17, and the package 20 was laid horizontally with facing up the fold-in part 8 which the easily peelable tape 12 was thermally welded, and was heated by a microwave oven.

The internal pressure was raised with heating, the packaging bag began to swell, and the steam venting port 11 opened by retraction of easily peelable seal potion of the seal part 15 so that the inner steam was released by leaking to outside, and the package 20 did not break. Also, the contents did not leak.

EXAMPLE 6

A packaging bag and a package were made according to the embodiment shown in FIG. 16.

As a front side main body film and a back side main body film, a composite film was prepared with a layer structure, providing aluminum oxide vapor deposition polyethylene terephthalate film (thickness 12 μm)(base layer)/biaxially oriented nylon film (thickness 15 μm)(intermediate layer)/non-oriented polypropylene film (thickness 80 μm)(sealant layer).

As an easily peelable tape 12, an easily peelable film for retort CMPS 013C (Manufactured by TOHCELLO CO., Ltd.) (thickness 50 μm) which was cut to tape form with nearly same width of a fold-in part was prepared, separately.

And then, a fold-in part 8 was formed by folding a front side of the main body film 2 into two at a folding line situated nearer the outside edge in relation to center to a width direction.

The same width with a fold-in part of an easily peelable tape 12 is thermally welded, along a mountain folded edge 7 in the space of sealant layer 2*s* of the fold-in part 8, and after a seal part 15 was formed, in a non-seal part 23 of each seal part 15 a steam venting port 11 was formed as a small hole.

The front side main body film 2 and a back side main body film 3 were laid on facing the mutual sealant layers 2*s*, 3*s*, and a bottom side and both sides in the vicinity of the fold-in part 8 were thermally welded to provide a bottom seal part 4 and side seal parts 5, respectively, so that a packaging bag 1 having the steam venting function was able to be fabricated.

The width of the side seal part 5 was made so as to be gradually broad while progressing from the bottom seal part side to a top seal part side.

An appropriate amount of water was filled into the packaging bag 1 and a package 20 was made by heat sealing a top intended part for heat seal 17, and the package 20 was laid horizontally with facing up the fold-in part 8 which the easily peelable tape 12 was thermally welded, and was heated by a microwave oven.

The internal pressure was raised with heating, the packaging bag began to swell, and the steam venting port 11 opened by retraction of easily peelable seal portion of the seal part 15 so that the steam in the inside was released by leaking to outside, and the package 20 did not break. Also, the contents did not leak.

As mentioned above, the present invention is suitable for a packaging bag in order to keep goods which are heated by use of heating device, such as a microwave oven and the like, and is suitable for a packaging bag to keep the goods.

The invention claimed is:

1. A packaging bag having a steam venting function, comprising:

first and second sheets facing each other and having edges which are sealed, the first sheet having a foldable portion including a first outer panel facing a second inner panel, the first and second panels being separated by a fold, and the foldable portion having a sealed region and an un-sealed region;

a steam venting port formed in the un-sealed region through the inner panel;

a steam venting port formed in the un-sealed region through the outer panel;

a peelable tape in the foldable portion, said peelable tape including a steam venting port formed therethrough corresponding in position to the steam venting port of the outer panel, wherein the peelable tape includes a peelable side which is sealed to the inner panel at the sealed region, and a non-peelable side which is sealed to the outer panel at the sealed region, wherein the peelable tape extends over the steam venting ports in the un-sealed region, and wherein, when steam of a predetermined pressure is in the bag, the peelable side peels from the inner panel to allow steam to escape the bag through the steam venting port in the inner panel and through the steam venting port in the peelable tape and the corresponding steam venting port in the outer panel, but the non-peelable side does not peel from the outer sheet, wherein the foldable portion has a width extending from the one sealed edge to another sealed edge, and the peelable tape extends substantially along the width, and wherein sides of the peelable tape includes holes through which the inner and outer panels contact each other and are sealed together at the sealed edges defining the width of the foldable portion, so as to further position the peelable tape relative to the foldable portion.

2. The packaging bag according to claim 1, wherein said un-sealed region includes a first side extending to the fold, and a plurality of other sides extending to the sealed region.

3. The packaging bag according to claim 1, wherein the un-sealed region is a plurality of un-sealed regions, and each of the steam venting ports is a plurality of steam venting ports, wherein a respective one of the plurality of steam venting ports is associated with one of the un-sealed regions.

4. The packaging bag according to claim 1, further comprising contents in the bag.

5. A packaging bag having a steam venting function, comprising:

first and second sheets facing each other and having edges which are sealed, the first sheet having a foldable portion including a first outer panel facing a second inner panel, the first and second panels being separated by a fold, and the foldable portion having a sealed region and an un-sealed region;

a steam venting port formed in the un-sealed region through the inner panel;

a steam venting port formed in the un-sealed region through the outer panel;

a peelable tape in the foldable portion, said peelable tape including a steam venting port formed therethrough corresponding in position to the steam venting port of the outer panel, wherein the peelable tape includes a peelable side which is sealed to the inner panel at the sealed region, and a non-peelable side which is sealed to the outer panel at the sealed region, wherein the peelable tape extends over the steam venting ports in the un-sealed region, and wherein, when steam of a predetermined pressure is in the bag, the peelable side peels from the inner panel to allow steam to escape the bag through the steam venting port in the inner panel and throuqh the steam venting port in the peelable tape and the corresponding steam venting port in the outer panel, but the non-peelable side does not peel from the outer panel, wherein the foldable portion has a width extending from one sealed edge, and the peelable tape extends substantially along the width, and wherein the foldable portion has a length extending from the fold, the peelable tape has a length, and the length of the peelable tape is greater than the length of the foldable portion.

6. A packaging bag having a steam venting function, comprising:

first and second sheets facing each other and having edges which are sealed, the first sheet having a foldable portion including a first outer panel facing a second inner panel, the first and second panels being separated by a fold, and the foldable portion having a sealed region and an un-sealed region;

a steam venting port formed in the un-sealed region through the inner panel;

a steam venting port formed in the un-sealed region through the outer panel;

a peelable tape in the foldable portion, said peelable tape including a steam venting port formed therethrough corresponding in position to the steam venting port of the outer panel, wherein the peelable tape includes a peelable side which is sealed to the inner panel at the sealed region, and a non-peelable side which is sealed to the outer panel at the sealed region, wherein the peelable tape extends over the steam venting ports in the un-sealed region, and wherein when steam of a predetermined pressure is in the bag the peelable side peels from the inner panel to allow steam to escape the bag through the steam venting port in the inner panel and through the steam venting port in the peelable tape and the corresponding steam venting port in the outer panel, but the non-peelable side does not peel from the outer panel, wherein said un-sealed region includes a first side extending to the fold and a purality of other sides extending to the sealed region, and wherein the un-sealed region is a plurality of un-sealed regions, and each of the steam venting ports is a plurality of steam venting ports, wherein a respective one of the plurality of steam venting ports is associated with one of the un-sealed regions, wherein the foldable portion has a width extending from one sealed edge to another sealed edge, and the peelable tape extends substantially along the width, and wherein sides of the peelable tape include holes through which the inner and outer panels contact each other and are sealed together at the sealed edges defining the width of the foldable portion, so as to further position the peelable tape relative to the foldable portion.

7. The packaging bag according to claim 6, wherein the foldable portion has a length extending from the fold, the peelable tape has a length, and the length of the peelable tape is greater than the length of the foldable portion.

8. The packaging bag according to claim 7, further comprising contents in the bag.

9. A packaging bag having a steam venting function, comprising:

first and second sheets facing each other and having edges which are sealed, the first sheet having a foldable portion including a first outer panel facing a second inner panel, the first and second panels being separated by a fold, and the foldable portion having a sealed region and an un-sealed region;

a steam venting port formed in the un-sealed region through the inner panel;

a steam venting port formed in the un-sealed region through the outer panel; and a peelable tape in the foldable portion, said peelable tape including a steam venting port formed therethrough corresponding in position to the steam venting port of the outer panel, wherein the peelable tape includes a peelable side which is sealed to the inner panel at the sealed region, and a non-peelable side which is sealed to the outer panel at the sealed region, wherein the peelable tape extends over the steam venting ports in the un-sealed region, wherein, when steam of a predetermined pressure is in the bag, the peelable side peels from the inner panel to allow steam to escape the bag through the steam venting port in the inner panel and through the steam venting port in the peelable tape and the corresponding steam venting port in the outer panel, but the non-peelable side does not peel from the outer panel, wherein said un-sealed region includes a first side extending to the fold, and a plurality of other sides extending to the sealed region, wherein the foldable portion has a width extending from one sealed edge to another sealed edge, and the peelable tape extends substantially along the width, wherein sides of the peelable tape include holes through which the inner and outer panels contact each other and are sealed together at the sealed edges defining the width of the foldable portion, so as to further position the peelable tape relative to the foldable portion, wherein the un-sealed region is a plurality of un-sealed regions, and each of the steam venting ports is a plurality of steam venting ports, wherein a respective one of the plurality of steam venting ports is associated with one of the un-sealed regions, and wherein the foldable portion has a length extending from the fold, the peelable tape has a length, and the length of the peelable tape is greater than the length of the foldable portion.

* * * * *

UNITED STATES PATENT AND TRADEMARK OFFICE

CERTIFICATE OF CORRECTION

PATENT NO. : 8,777,486 B2
APPLICATION NO. : 10/565272
DATED : July 15, 2014
INVENTOR(S) : Hidenobu Miyake et al.

It is certified that error appears in the above-identified patent and that said Letters Patent is hereby corrected as shown below:

In the Specification

Column 1, line 6, Delete "JP 2004" and insert -- JP2004 --, therefor.
Column 1, line 6, Delete "filled in Jul. 23," and insert -- filed Jul. 23, --, therefor.
Column 1, line 7, Delete "2003-278921, filled" and insert -- 2003-278921, filed --, therefor.
Column 1, line 8, Delete "2003-362895, filled" and insert -- 2003-362895, filed --, therefor.
Column 1, line 8 to 9, Delete "2003-362896, filled" and insert -- 2003-362896, filed --, therefor.
Column 1, line 9, Delete "filled Oct. 31," and insert -- filed Oct. 31, --, therefor.
Column 1, line 10, Delete "2004-021359, filled" and insert -- 2004-021359, filed --, therefor.
Column 1, line 11, Delete "2004-021360, filled" and insert -- 2004-021360, filed --, therefor.
Column 1, line 11, Delete "2004-131017, filled" and insert -- 2004-131017, filed --, therefor.
Column 1, line 12, Delete "2004-131018, filled" and insert -- 2004-131018, filed --, therefor.

In the Claims

Column 21, line 49, in Claim 1, delete "sheet," and insert -- panel, --, therefor.
Column 22, line 27, in Claim 5, delete "throuqh" and insert -- through --, therefor.
Column 22, line 61, in Claim 6, delete "wherein" and insert -- wherein, --, therefor.
Column 22, line 62, in Claim 6, delete "bag" and insert -- bag, --, therefor.
Column 23, line 2, in Claim 6, delete "purality" and insert -- plurality --, therefor.

Signed and Sealed this
Nineteenth Day of May, 2015

Michelle K. Lee

Michelle K. Lee
*Director of the United States Patent and Trademark Office*